US012405019B2

(12) United States Patent
Sasaki

(10) Patent No.: US 12,405,019 B2
(45) Date of Patent: Sep. 2, 2025

(54) AIR CONDITIONING SYSTEM, ABNORMALITY ESTIMATION METHOD FOR AIR CONDITIONING SYSTEM, AIR CONDITIONER, AND ABNORMALITY ESTIMATION METHOD FOR AIR CONDITIONER

(71) Applicant: FUJITSU GENERAL LIMITED, Kanagawa (JP)

(72) Inventor: Shinji Sasaki, Kanagawa (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 225 days.

(21) Appl. No.: 18/280,786

(22) PCT Filed: Feb. 24, 2022

(86) PCT No.: PCT/JP2022/007463
§ 371 (c)(1),
(2) Date: Sep. 7, 2023

(87) PCT Pub. No.: WO2022/209445
PCT Pub. Date: Oct. 6, 2022

(65) Prior Publication Data

US 2024/0142125 A1 May 2, 2024

(30) Foreign Application Priority Data

Mar. 31, 2021 (JP) ..... 2021-062277

(51) Int. Cl.
*F24F 11/32* (2018.01)

(52) U.S. Cl.
CPC ..... *F24F 11/32* (2018.01)

(58) Field of Classification Search
CPC ..... F24F 11/32; F24F 11/38; F25B 49/005; F25B 2313/0233; F25B 2313/0314;
(Continued)

(56) References Cited

U.S. PATENT DOCUMENTS

2017/0276413 A1 9/2017 Takeichi et al.
2020/0049364 A1* 2/2020 Nakamura ..... F24F 11/38
(Continued)

FOREIGN PATENT DOCUMENTS

JP 11-337236 12/1999
JP 2001-235210 8/2001
(Continued)

OTHER PUBLICATIONS

International Search Report (ISR) from International Searching Authority (Japan Patent Office) in International Pat. Appl. No. PCT/JP2022/007463, dated May 10, 2022, together with an English language translation.

*Primary Examiner* — Marc E Norman
(74) *Attorney, Agent, or Firm* — Greenblum & Bernstein, P.L.C.

(57) ABSTRACT

An air conditioner includes a refrigerant circuit in which indoor units are connected to an outdoor unit. The conditioner includes a processor to detect a state quantity related to control on the air conditioner, acquire a detected value of the detected quantity and estimate occurrence of abnormality of the circuit by using a detected value of a feature value by assuming that the quantity related to abnormality of the circuit is adopted as the feature value. The estimating adopts the outdoor unit and each of the indoor units as a single pair, estimates occurrence of abnormality in the circuit for each of the pairs, estimates that abnormality has occurred in the indoor unit of a subject pair when estimating that abnormality has occurred in any of the pair, and estimates that abnormality has occurred in the outdoor unit when estimating that abnormality has occurred in all of the pairs.

33 Claims, 14 Drawing Sheets

(58) Field of Classification Search
CPC ..... F25B 2313/0315; F25B 2500/19; F25B 2500/222; F25B 2700/171; F25B 2700/1931; F25B 2700/1933; F25B 2700/2104; F25B 2700/2106; F25B 2700/21151; F25B 2700/21152
See application file for complete search history.

(56) References Cited

U.S. PATENT DOCUMENTS

| | | | | |
|---|---|---|---|---|
| 2022/0170975 | A1* | 6/2022 | Hikita | G06N 3/048 |
| 2022/0268503 | A1 | 8/2022 | Yoshimi et al. | |
| 2024/0353160 | A1* | 10/2024 | Okumura | F24F 11/61 |

FOREIGN PATENT DOCUMENTS

| | | |
|---|---|---|
| JP | 2004-169989 | 6/2004 |
| JP | 2012-141110 | 7/2012 |
| JP | 2020-016358 | 1/2020 |
| JP | 2020-073838 | 5/2020 |
| JP | 2021-042949 | 3/2021 |

* cited by examiner

FIG.6

| FIRST FEATURE VALUE USED FOR COOLER ESTIMATION MODEL | SECOND FEATURE VALUE USED FOR ABNORMALITY ESTIMATION MODEL AT TIME OF COOLING |
|---|---|
| ROTATION SPEED OF COMPRESSOR | ROTATION SPEED OF COMPRESSOR |
| HIGH-PRESSURE SATURATION TEMPERATURE | HIGH-PRESSURE SATURATION TEMPERATURE |
| SUCTION TEMPERATURE | SUCTION TEMPERATURE |
| LOW-PRESSURE REFRIGERANT TEMPERATURE | LOW-PRESSURE REFRIGERANT TEMPERATURE |
| DEGREE OF SUPERCOOLING OF REFRIGERANT (HIGH-PRESSURE SATURATION TEMPERATURE-OUTDOOR HEAT EXCHANGE OUTLET TEMPERATURE) | |
| OUTDOOR AIR TEMPERATURE | OUTDOOR AIR TEMPERATURE |
| | DISCHARGE PRESSURE |
| | OUTDOOR UNIT HEAT EXCHANGE OUTLET TEMPERATURE |
| HEAT EXCHANGE INLET TEMPERATURE AT SIDE OF INDOOR UNIT | HEAT EXCHANGE INLET TEMPERATURE AT SIDE OF INDOOR UNIT |
| HEAT EXCHANGE OUTLET TEMPERATURE AT SIDE OF INDOOR UNIT | HEAT EXCHANGE OUTLET TEMPERATURE AT SIDE OF INDOOR UNIT |
| DEGREE OF OPENING OF INDOOR UNIT EXPANSION VALVE | DEGREE OF OPENING OF INDOOR UNIT EXPANSION VALVE |

FIG.7

| FIRST FEATURE VALUE USED FOR HEATER ESTIMATION MODEL | SECOND FEATURE VALUE USED FOR ABNORMALITY ESTIMATION MODEL AT TIME OF HEATING |
|---|---|
| DEGREE OF OPENING OF OUTDOOR UNIT EXPANSION VALVE | DEGREE OF OPENING OF OUTDOOR UNIT EXPANSION VALVE |
| ROTATION SPEED OF COMPRESSOR | ROTATION SPEED OF COMPRESSOR |
| DEGREE OF SUCTION SUPERHEAT (SUCTION TEMPERATURE-LOW-PRESSURE SATURATION TEMPERATURE) | |
| OUTDOOR AIR TEMPERATURE | OUTDOOR AIR TEMPERATURE |
| | DISCHARGE TEMPERATURE |
| | SUCTION TEMPERATURE |
| | LOW-PRESSURE SATURATION TEMPERATURE |
| | SUCTION PRESSURE |
| HEAT EXCHANGE INLET TEMPERATURE AT SIDE OF INDOOR UNIT | HEAT EXCHANGE INLET TEMPERATURE AT SIDE OF INDOOR UNIT |
| HEAT EXCHANGE OUTLET TEMPERATURE AT SIDE OF INDOOR UNIT | HEAT EXCHANGE OUTLET TEMPERATURE AT SIDE OF INDOOR UNIT |
| DEGREE OF OPENING OF INDOOR UNIT EXPANSION VALVE | DEGREE OF OPENING OF INDOOR UNIT EXPANSION VALVE |

FIG.12

| PAIR | ESTIMATION RESULT OF ABNORMALITY ESTIMATION UNIT |
|---|---|
| P1 | ABNORMAL |
| P2 | ABNORMAL |
| P3 | ABNORMAL |
| P4 | ABNORMAL |

→ ABNORMALITY IN OUTDOOR UNIT 2

| PAIR | ESTIMATION RESULT OF ABNORMALITY ESTIMATION UNIT |
|---|---|
| P1 | NORMAL |
| P2 | NORMAL |
| P3 | ABNORMAL |
| P4 | NORMAL |

→ ABNORMALITY IN INDOOR UNIT 3C IN P3

AIR CONDITIONING SYSTEM, ABNORMALITY ESTIMATION METHOD FOR AIR CONDITIONING SYSTEM, AIR CONDITIONER, AND ABNORMALITY ESTIMATION METHOD FOR AIR CONDITIONER

FIELD

The present invention relates to an air conditioning system, an abnormality estimation method for an air conditioning system, an air conditioner, and an abnormality estimation method for an air conditioner.

BACKGROUND

Various methods for detecting abnormality related to a refrigerant circuit in an air conditioner or a sign of the abnormality have been proposed. For example, Patent Literature 1 proposes a method of detecting abnormality of an air conditioner by performing learning while adopting, as normal data, an ability score that is obtained by using values detected by various kinds of sensors, and comparing values that are detected by the various kinds of sensors in a period different from a learning period with the normal data.

CITATION LIST

Patent Literature

Patent Literature 1: Japanese Laid-open Patent Publication No. 2020-16358

SUMMARY

Technical Problem

However, in Patent Literature 1, only occurrence of abnormality of the air conditioner is estimated. Therefore, for example, with respect to an air conditioner in which a plurality of indoor units are connected to an outdoor unit by refrigerant pipes, it is impossible to estimate in which of the outdoor unit and the indoor units abnormality has occurred.

In view of the foregoing situations, an object of the present invention is to provide an air conditioning system, an abnormality estimation method for an air conditioning system, an air conditioner, and an abnormality estimation method for an air conditioner, which are able to estimate in which of an indoor unit and an outdoor unit abnormality has occurred.

Solution to Problem

According to an aspect of an embodiment, an air conditioning system includes an air conditioner and a server. The air conditioner includes a refrigerant circuit in which at least one or more indoor units are connected to an outdoor unit by refrigerant pipes. The server is communicably connected to the air conditioner. The air conditioner includes an first memory and first processing circuitry coupled to the first memory. The first processing circuitry is configured to detect a state quantity related to control on the air conditioner. The first processing circuitry is configured to acquire a detected value of the state quantity that is detected by the detecting. The first processing circuitry is configured to transmit the detected value acquired by the acquiring to the server. The server includes a second memory and second processing circuitry coupled to the second memory. The second processing circuitry is configured to receive the detected value from the air conditioner. The second processing circuitry is configured to estimate occurrence of abnormality of the refrigerant circuit by using a detected value of a feature value by assuming that the state quantity related to abnormality of the refrigerant circuit is adopted as the feature value. The estimating adopts the outdoor unit and each of the indoor units as a single pair, estimates occurrence of abnormality in the refrigerant circuit for each of the pairs, estimates that abnormality has occurred in the indoor unit of a subject pair when estimating that abnormality has occurred in any of the pairs, and estimates that abnormality has occurred in the outdoor unit when estimating that abnormality has occurred in all of the pairs

Advantageous Effects of Invention

According to one aspect, it is possible to estimate in which of an outdoor unit and an indoor unit abnormality has occurred.

BRIEF DESCRIPTION OF DRAWINGS

FIG. 6 is an explanatory diagram illustrating examples of a first feature value that is used for first to third cooler estimation models and a second feature value that is used for a cooling-period abnormality estimation model.

FIG. 7 is an explanatory diagram illustrating examples of a first feature value that is used for first to third heater estimation models and a second feature value that is used for a heating-period abnormality estimation model.

FIG. 12 is an explanatory diagram illustrating an example of a determination result obtained by a determination unit.

DESCRIPTION OF EMBODIMENTS

Embodiments of an air conditioning system, an abnormality estimation method for an air conditioning system, an air conditioner, and an abnormality estimation method for an air conditioner disclosed in the present application will be described in detail below based on the drawings. Meanwhile, the disclosed technology is not limited by the present embodiments. In addition, each of the embodiments described below may be modified appropriately as long as no contradiction is derived.

First Embodiment

Configuration of Air Conditioner

Figure 1:
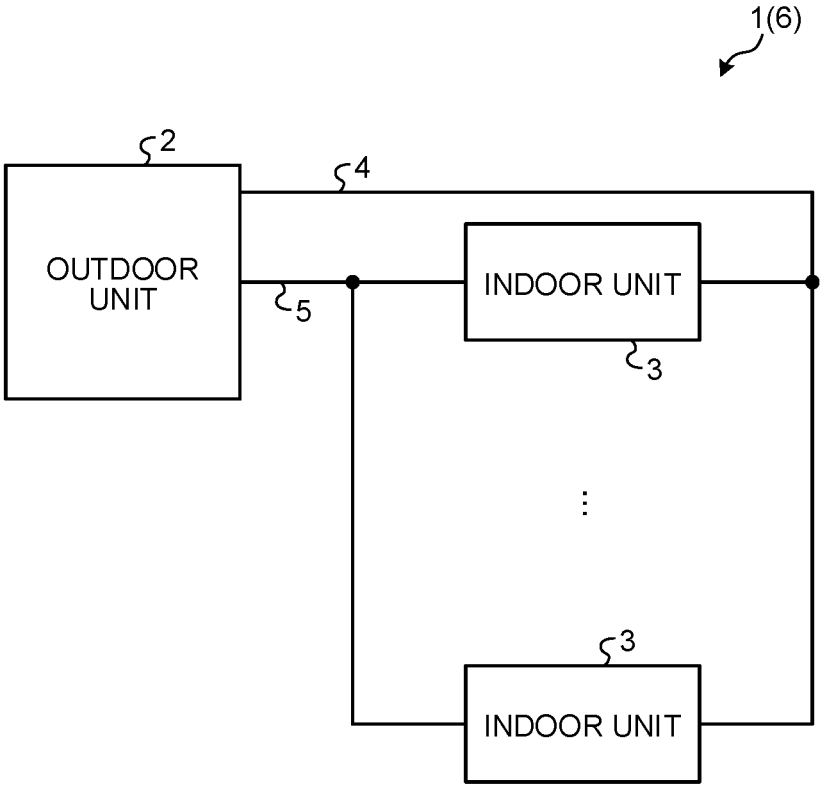
FIG. 1 is an explanatory diagram illustrating an example of an air conditioner of a present embodiment.

FIG. 1 is an explanatory diagram illustrating an example of an air conditioner 1 of the present embodiment. The air conditioner 1 illustrated in FIG. 1 includes a single outdoor unit 2 and N indoor units 3 (N is a natural number equal to or larger than 2). The outdoor unit 2 is connected to each of the indoor units 3 in a parallel manner via a liquid pipe 4 and a gas pipe 5. Further, a refrigerant circuit 6 of the air conditioner 1 is formed by connecting the outdoor unit 2 and the indoor units 3 to each other by refrigerant pipes, such as the liquid pipe 4 and the gas pipe 5.

Configuration of Outdoor Unit

Figure 2:
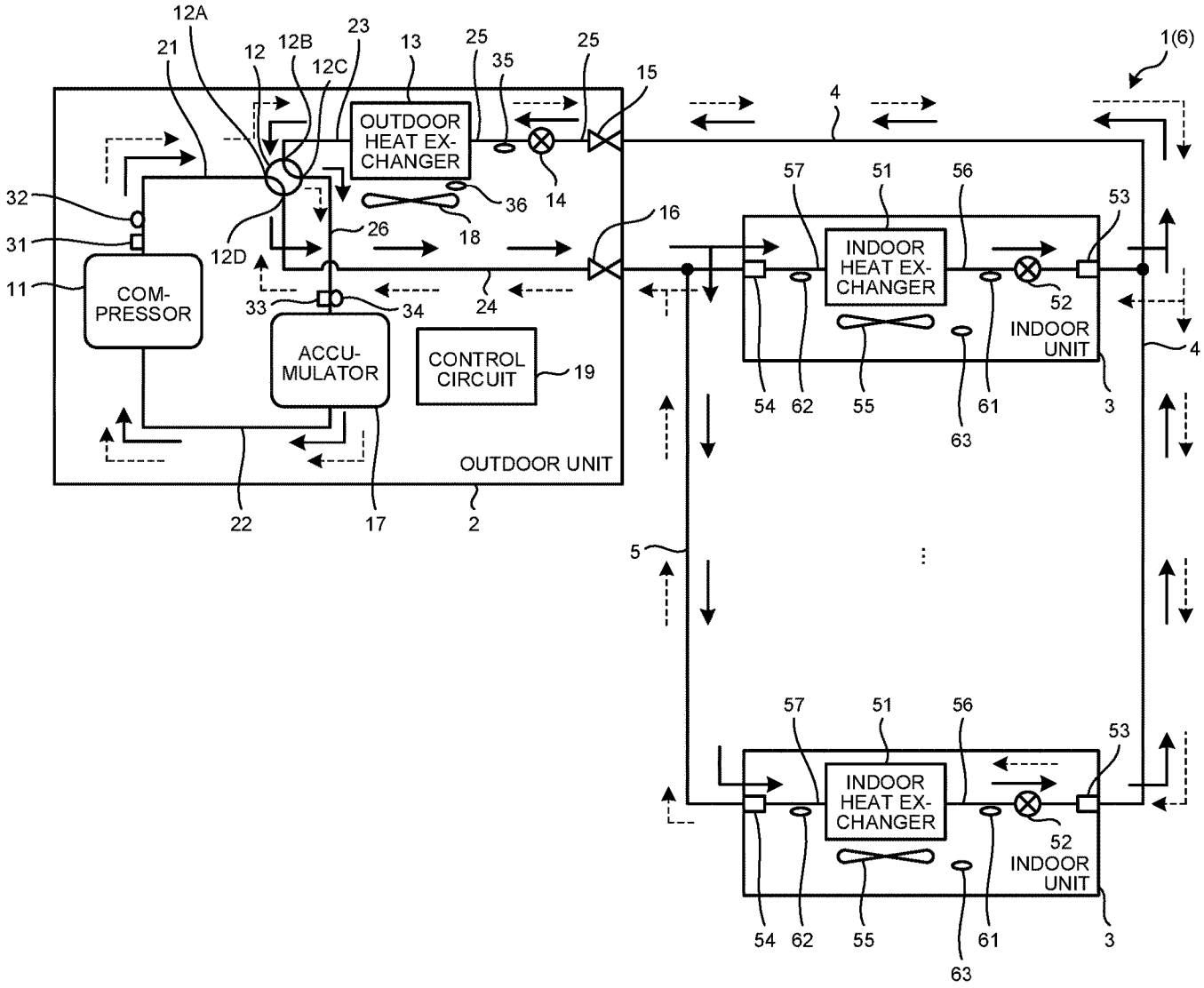
FIG. 2 is an explanatory diagram illustrating an example of an outdoor unit and indoor units.

FIG. 2 is an explanatory diagram illustrating an example of the outdoor unit 2 and the N indoor units 3. The outdoor unit 2 includes a compressor 11, a four-way valve 12, an outdoor heat exchanger 13, an outdoor unit expansion valve 14, a first stop valve 15, a second stop valve 16, an accumulator 17, an outdoor unit fan 18, and a control circuit 19. The compressor 11, the four-way valve 12, the outdoor heat exchanger 13, the outdoor unit expansion valve 14, the first stop valve 15, the second stop valve 16, and the accumulator 17 as described above are connected to one another by each of refrigerant pipes to be described in detail below, and used to form an outdoor-side refrigerant circuit that is a part of the refrigerant circuit 6.

The compressor 11 is, for example, a variable capacity compressor of a pressurized container type in which operating capacity can be changed in accordance with drive of a motor (not illustrated) for which rotation speed is controlled by an inverter. A refrigerant discharge side of the compressor 11 is connected to a first port 12A of the four-way valve 12 by a discharge pipe 21. Further, a refrigerant suction side of the compressor 11 is connected to a refrigerant outflow side of the accumulator 17 by a suction pipe 22.

The four-way valve 12 is a valve for changing a flow direction of a refrigerant in the refrigerant circuit 6, and includes the first to fourth ports 12A to 12D. The first port 12A is connected to the refrigerant discharge side of the compressor 11 by the discharge pipe 21. The second port 12B is connected to one refrigerant port of the outdoor heat exchanger 13 by an outdoor refrigerant pipe 23. The third port 12C is connected to a refrigerant inflow side of the accumulator 17 by an outdoor refrigerant pipe 26. Further, the fourth port 12D is connected to the second stop valve 16 by an outdoor gas pipe 24.

The outdoor heat exchanger 13 performs heat exchange between the refrigerant and outdoor air that is taken into the outdoor unit 2 by rotation of the outdoor unit fan 18. The one refrigerant port of the outdoor heat exchanger 13 is connected to the second port 12B of the four-way valve 12 by the outdoor refrigerant pipe 23. Another refrigerant ports of the outdoor heat exchanger 13 is connected to the first stop valve 15 by an outdoor liquid pipe 25. The outdoor heat exchanger 13 functions as a condenser when the air conditioner 1 performs cooling operation, and functions as an evaporator when the air conditioner 1 performs heating operation.

The outdoor unit expansion valve 14 is an electronic expansion valve that is arranged in the outdoor liquid pipe 25 and that is driven by a pulse motor (not illustrated). A degree of opening of the outdoor unit expansion valve 14 is adjusted in accordance with the number of pulses given to the pulse motor, so that an amount of the refrigerant that flows into the outdoor heat exchanger 13 or an amount of the refrigerant that flows out of the outdoor heat exchanger 13 is adjusted. The degree of opening of the outdoor unit expansion valve 14 is adjusted such that when the air conditioner 1 performs heating operation, a degree of suction superheat of refrigerant at the refrigerant suction side of the compressor 11 reaches a target suction superheat. Further, the degree of opening of the outdoor unit expansion valve 14 is set to a fully-opened state when the air conditioner 1 performs cooling operation.

The refrigerant inflow side of the accumulator 17 is connected to the third port 12C of the four-way valve 12 by the outdoor refrigerant pipe 26. Further, the refrigerant outflow side of the accumulator 17 is connected to a refrigerant inflow side of the compressor 11 by the suction pipe 22. The accumulator 17 separates the refrigerant that has flown into the accumulator 17 from the outdoor refrigerant pipe 26 into gas refrigerant and liquid refrigerant, and causes only the gas refrigerant to be sucked into the compressor 11.

The outdoor unit fan 18 is made of a resin material and arranged in the vicinity of the outdoor heat exchanger 13. The outdoor unit fan 18 takes outdoor air into the outdoor unit 2 from a suction port (not illustrated) in accordance with rotation of a fan motor (not illustrated), and discharges the outdoor air, which has been subjected to heat exchange with the refrigerant in the outdoor heat exchanger 13, to the outside of the outdoor unit 2 from a discharge port (not illustrated).

Further, a plurality of sensors are arranged in the outdoor unit 2. In the discharge pipe 21, a discharge pressure sensor 31 that detects discharge pressure as pressure of the refrigerant that is discharged from the compressor 11, and a discharge temperature sensor 32 that detects temperature of the refrigerant that is discharged from the compressor 11, that is, discharge temperature, are arranged. In the vicinity of a refrigerant inlet of the accumulator 17 in the outdoor refrigerant pipe 26, a suction pressure sensor 33 that detects suction pressure as pressure of the refrigerant that is sucked into the compressor 11, and a suction temperature sensor 34 that detects temperature of the refrigerant that is sucked into the compressor 11 are arranged.

In the outdoor liquid pipe 25 between the outdoor heat exchanger 13 and the outdoor unit expansion valve 14, a refrigerant temperature sensor 35 that detects temperature of the refrigerant that flows into the outdoor heat exchanger 13 or temperature of the refrigerant that flows out of the outdoor heat exchanger 13 is arranged. Furthermore, in the vicinity of a suction port (not illustrated) of the outdoor unit 2, an outdoor air temperature sensor 36 that detects temperature of outdoor air that flows into the outdoor unit 2, that is, outdoor air temperature, is arranged.

Figure 3:
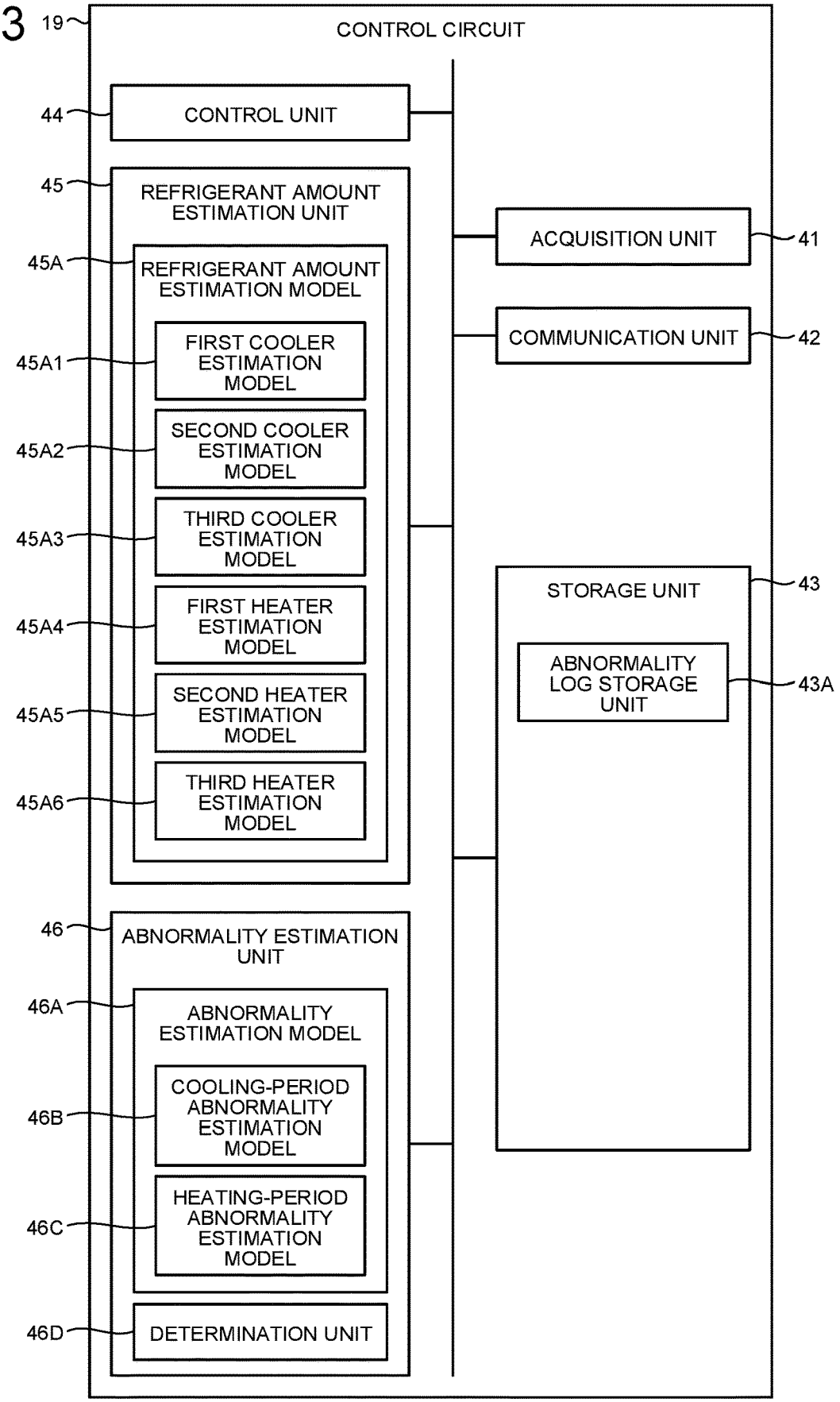
FIG. 3 is a block diagram illustrating one example of a control circuit of the outdoor unit.

The control circuit 19 controls the entire air conditioner 1. FIG. 3 is a block diagram illustrating an example of the control circuit 19 of the outdoor unit 2. The control circuit 19 includes an acquisition unit 41, a communication unit 42, a storage unit 43, a control unit 44, a refrigerant amount estimation unit 45, and an abnormality estimation unit 46. The acquisition unit 41 acquires sensor values of detection units that are the various kinds of sensors as described above. The communication unit 42 is a communication interface for performing communication with a communication unit of each of the indoor units 3. The storage unit 43 is, for example, a flash memory, and stores therein a control program of the outdoor unit 2, operating state quantities, such as detection values, corresponding to detection signals from the various kinds of sensors, driving states of the compressor 11 and the outdoor unit fan 18, operating information transmitted from each of the indoor units 3 (for example, including operating and stop information, an operating mode, such as cooling or heating, or the like), rated capacity of the outdoor unit 2, requested capacity of each of the indoor units 3, or the like. Further, the storage unit 43 includes an abnormality log storage unit 43A that stores therein an abnormality log (to be described later).

The control unit 44 periodically (for example, every 30 seconds) acquires the detected values that are obtained by the various kinds of sensors via the communication unit 42, and receives input of signals including the operating state quantity that is transmitted from each of the indoor units 3 via the communication unit 42. The control unit 44 adjusts the degree of opening of the outdoor unit expansion valve 14 and controls drive of the compressor 11 based on the various kinds of input information as described above.

The refrigerant amount estimation unit 45 includes a refrigerant amount estimation model 45A that estimates a refrigerant shortage rate of the refrigerant circuit 6 by using a detected value of a first feature value, where the first feature value represents an operating state quantity that is related to a refrigerant amount of the refrigerant circuit 6. In the present embodiment, for example, a relative refrigerant amount is used as an amount of refrigerant that remains in the refrigerant circuit 6. Specifically, the refrigerant amount estimation model 45A is a model that estimates the refrigerant shortage rate of the refrigerant circuit 6 (indicating an amount of decrease from a prescribed amount, where 100% indicates that the prescribed amount of refrigerant is stored, and the same applies to the following). The refrigerant amount estimation model 45A includes a first cooler estimation model 45A1, a second cooler estimation model 45A2, a third cooler estimation model 45A3, a first heater estimation model 45A4, a second heater estimation model 45A5, and a third heater estimation model 45A6. Each of the refrigerant amount estimation models 45A will be described in detail later.

Figure 4:
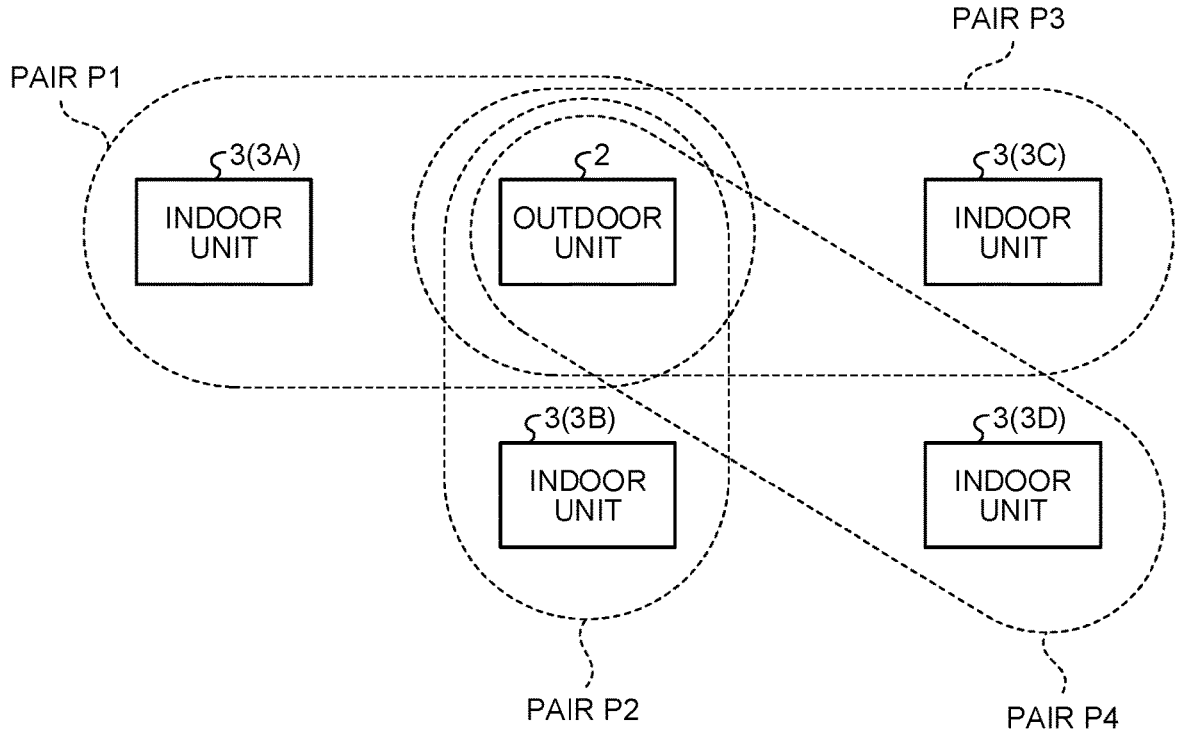
FIG. 4 is an explanatory diagram illustrating an example of pairing such that the outdoor unit and each of the indoor units are combined as a single pair.

FIG. 4 is an explanatory diagram illustrating an example of pairing such that the outdoor unit 2 and each of the indoor units 3 are combined as a single pair. Meanwhile, for convenience of explanation, a case will be described in which the air conditioner 1 includes, for example, the single outdoor unit 2 and includes, for example, the four indoor units 3 (3A, 3B, 3C, 3D) that are connected to the outdoor unit 2. In this example, the single outdoor unit 2 and the single indoor unit 3 forms a single pair such that the outdoor unit 2 and the indoor unit 3A forms a pair P1, the outdoor unit 2 and the indoor unit 3B forms a pair P2, the outdoor unit 2 and the indoor unit 3C forms a pair P3, and the outdoor unit 2 and the indoor unit 3D forms a pair P4.

The abnormality estimation unit 46 includes an abnormality estimation model 46A that estimates whether the refrigerant circuit 6 is abnormal or normal for each of the pairs P1 to P4 of the outdoor unit 2 and the indoor units 3 by using a detected value of a second feature value that is related to abnormality of the refrigerant circuit 6 among the operating state quantities. The abnormality estimation unit 46 estimates abnormality of the refrigerant circuit 6 for each of the pairs P1 to P4. If it is estimated that abnormality of the refrigerant circuit 6 has occurred in any of the pairs, it is estimated that the abnormality has occurred due to the indoor unit 3 of the subject pair. Further, if the abnormality estimation unit 46 estimates that abnormality has occurred in all of the pairs P1 to P4, the abnormality estimation unit 46 estimates that the abnormality has occurred due to the outdoor unit 2.

The abnormality estimation model 46A includes a cooling-period abnormality estimation model 46B that is used when the air conditioner 1 performs cooling operation, and a heating-period abnormality estimation model 46C that is used when the air conditioner 1 performs heating operation. Further, the abnormality estimation unit 46 includes a determination unit 46D that is able to identify the outdoor unit 2 or the indoor unit 3 as a cause of the abnormality of the refrigerant circuit 6 based on an abnormality estimation result of each of the pairs P1 to P4. Each of the abnormality estimation models 46A as described above will be described in detail later.

Configuration of Indoor Unit

As illustrated in FIG. 2, the indoor unit 3 includes an indoor heat exchanger 51, an indoor unit expansion valve 52, a liquid pipe connection portion 53, a gas pipe connection portion 54, and an indoor unit fan 55. The indoor heat exchanger 51, the indoor unit expansion valve 52, the liquid pipe connection portion 53, and the gas pipe connection portion 54 are connected to one another by each of refrigerant pipes to be described later, and constitutes an indoor unit refrigerant circuit that is a part of the refrigerant circuit 6.

The indoor heat exchanger 51 performs heat exchange between the refrigerant and indoor air that is taken into the indoor unit 3 from a suction port (not illustrated) by rotation of the indoor unit fan 55. One refrigerant port of the indoor heat exchanger 51 is connected to the liquid pipe connection portion 53 by an indoor liquid pipe 56. Further, another refrigerant port of the indoor heat exchanger 51 is connected to the gas pipe connection portion 54 by an indoor gas pipe 57. The indoor heat exchanger 51 functions as a condenser when the air conditioner 1 performs heating operation. In contrast, the indoor heat exchanger 51 functions as an evaporator when the air conditioner 1 performs cooling operation.

The indoor unit expansion valve 52 is arranged in the indoor liquid pipe 56 and is an electronic expansion valve. When the indoor heat exchanger 51 functions as an evaporator, that is, when the indoor unit 3 performs cooling operation, a degree of opening of the indoor unit expansion valve 52 is adjusted such that a degree of superheat of refrigerant at a refrigerant outlet side (at the side of the gas pipe connection portion 54) of the indoor heat exchanger 51 reaches a target degree of superheat of the refrigerant.

Further, when the indoor heat exchanger 51 functions as a condenser, that is, when the indoor unit 3 performs heating operation, the degree of opening of the indoor unit expansion valve 52 is adjusted such that a degree of supercooling of refrigerant at a refrigerant outlet side (at the side of the liquid pipe connection portion 53) of the indoor heat exchanger 51 reaches the target degree of supercooling of the refrigerant. Here, the target degree of superheat of the refrigerant and the target degree of supercooling of the refrigerant are a degree of superheat of the refrigerant and a degree of supercooling of the refrigerant that are needed to cause the indoor unit 3 to fully demonstrate cooling capacity and heating capacity.

The indoor unit fan 55 is made of a resin material and arranged in the vicinity of the indoor heat exchanger 51. The indoor unit fan 55, by being rotated by a fan motor (not illustrated), takes indoor air into the indoor unit 3 from a suction port (not illustrated), and discharges the indoor air that has been subjected to heat exchange with the refrigerant in the indoor heat exchanger 51 from a discharge port (not illustrated).

Various sensors are arranged in the indoor unit 3. In the indoor liquid pipe 56, a liquid-side refrigerant temperature sensor 61 that detects temperature of the refrigerant that flows into the indoor heat exchanger 51 (heat exchange inlet temperature at the side of the indoor unit at the time of cooling operation) or temperature of the refrigerant that flows out of the indoor heat exchanger 51 (heat exchange outlet temperature at the side of the indoor unit at the time of heating operation) is arranged between the indoor heat exchanger 51 and the indoor unit expansion valve 52. In the indoor gas pipe 57, a gas-side temperature sensor 62 that detects temperature of the refrigerant that flows out of the indoor heat exchanger 51 (heat exchange outlet temperature at the side of the indoor unit at the time of cooling operation) or temperature of the refrigerant that flows into the indoor heat exchanger 51 (heat exchange inlet temperature at the side of the indoor unit at the time of heating operation) is arranged. In the vicinity of a suction port (not illustrated) of the indoor unit 3, a suction temperature sensor 63 that detects temperature of the indoor air that flows into the indoor unit 3, that is, suction temperature, is arranged.

Operation of Refrigerant Circuit

Flow of the refrigerant in the refrigerant circuit 6 and operation of each of the units when the air conditioner 1 of the present embodiment performs air conditioning operation will be described below. Meanwhile, arrows in FIG. 1 indicate flows of the refrigerant at the time of heating operation.

When the air conditioner 1 performs heating operation, the four-way valve 12 is switched such that the first port 12A and the fourth port 12D communicate with each other and the second port 12B and the third port 12C communicate with each other. Accordingly, the refrigerant circuit 6 enters a heating cycle in which each of the indoor heat exchangers 51 functions as a condenser and the outdoor heat exchanger 13 functions as an evaporator. Meanwhile, for convenience of explanation, the flow of the refrigerant at the time of heating operation is indicated by bold arrows in FIG. 2.

If the compressor 11 drives when the refrigerant circuit 6 is in the state as described above, the refrigerant that is discharged from the compressor 11 flows through the discharge pipe 21, flows into the four-way valve 12, flows through the outdoor gas pipe 24 from the four-way valve 12, and flows into the gas pipe 5 via the second stop valve 16. The refrigerant that flows through the gas pipe 5 flows into each of the indoor units 3 in a distributed manner via each of the gas pipe connection portions 54. The refrigerant that has flown into each of the indoor units 3 in a distributed manner flows through each of the indoor gas pipes 57 and flows into each of the indoor heat exchangers 51. The refrigerant that has flown into each of the indoor heat exchangers 51 is subjected to heat exchange with the indoor air that is taken into each of the indoor units 3 by rotation of each of the indoor unit fans 55, and condenses. In other words, each of the indoor heat exchangers 51 functions as a condenser and the indoor air that is heated by the refrigerant in each of the indoor heat exchangers 51 is blown into a room from a discharge port (not illustrated), so that the room in which each of the indoor units 3 is installed is heated.

The refrigerant that has flown into each of the indoor liquid pipes 56 from each of the indoor heat exchangers 51 is depressurized by passing through each of the indoor unit expansion valves 52 for which the degree of opening is adjusted such that the degree of supercooling of the refrigerant at a refrigerant outlet side of each of the indoor heat exchangers 51 reaches a target degree of supercooling of the refrigerant. Here, the target degree of supercooling of the refrigerant is determined based on cooling capacity that is needed in each of the indoor units 3.

The refrigerant that has been depressurized by each of the indoor unit expansion valves 52 flows out to the liquid pipe 4 from each of the indoor liquid pipes 56 via each of the liquid pipe connection portions 53. The refrigerants that are collected in the liquid pipe 4 flow into the outdoor unit 2 via the first stop valve 15. The refrigerant that has flown into the first stop valve 15 of the outdoor unit 2 flows through the outdoor liquid pipe 25 and depressurized by passing through the outdoor unit expansion valve 14. The refrigerant that has been depressurized by the outdoor unit expansion valve 14 flows through the outdoor liquid pipe 25, flows into the outdoor heat exchanger 13, is subjected to heat exchange with the outdoor air that has flown through the suction port (not illustrated) of the outdoor unit 2 by rotation of the outdoor unit fan 18, and evaporates. The refrigerant that has flown out to the outdoor refrigerant pipe 26 from the outdoor heat exchanger 13 flows into the four-way valve 12, the outdoor refrigerant pipe 26, the accumulator 17, and the suction pipe 22 in this order, is sucked into the compressor 11 where the refrigerant is compressed again, and flows out to the outdoor gas pipe 24 by the first port 12A and the fourth port 12D of the four-way valve 12.

Further, when the air conditioner 1 performs cooling operation, the four-way valve 12 is switched such that the first port 12A and the second port 12B communicate with each other and the third port 12C and the fourth port 12D communicate with each other. Accordingly, the refrigerant circuit 6 enters a cooling cycle in which each of the indoor heat exchangers 51 functions as an evaporator and the outdoor heat exchanger 13 functions as a condenser. Meanwhile, for convenience of explanation, the flow of the refrigerant at the time of cooling operation is indicated by dashed arrows in FIG. 2.

If the compressor 11 drives when the refrigerant circuit 6 is in the state as described above, the refrigerant that is discharged from the compressor 11 flows through the discharge pipe 21, flows into the four-way valve 12, flows through the outdoor refrigerant pipe 26 from the four-way valve 12, and flows into the outdoor heat exchanger 13. The refrigerant that has flown into the outdoor heat exchanger 13 is subjected to heat exchange with outdoor air that is taken into the outdoor unit 2 by rotation of the outdoor unit fan 18, and condenses. In other words, the outdoor heat exchanger 13 functions as a condenser and the indoor air that is heated by the refrigerant in the outdoor heat exchanger 13 is blown out of the room from a discharge port (not illustrated).

The refrigerant that has flown into the outdoor liquid pipe 25 from the outdoor heat exchanger 13 is depressurized by passing through the outdoor unit expansion valve 14 for which the degree of opening is adjusted to full-open. The refrigerant that has been depressurized by the outdoor unit expansion valve 14 flows through the liquid pipe 4 via the first stop valve 15 and flows into each of the indoor units 3 in a distributed manner. The refrigerant that has flown into each of the indoor units 3 in a distributed manner flows through the indoor liquid pipe 56 via each of the liquid pipe connection portions 53 and is depressurized by passing through the indoor unit expansion valve 52 for which the degree of opening is adjusted such that the degree of supercooling of the refrigerant at the refrigerant outlet of the indoor heat exchanger 51 reaches the target degree of supercooling of the refrigerant. The refrigerant that has been depressurized by the indoor unit expansion valve 52 flows through the indoor liquid pipe 56, flows into the indoor heat exchanger 51, is subjected to heat exchange with the indoor air that has flown in from the suction port (not illustrated) of the indoor unit 3 by rotation of the indoor unit fan 55, and evaporates. In other words, each of the indoor heat exchangers 51 functions as an evaporator and the indoor air that is cooled by the refrigerant in each of the indoor heat exchangers 51 is blown into the room from a discharge port (not illustrated), so that the room in which each of the indoor units 3 is installed is cooled.

The refrigerant that flows into the gas pipe 5 from the indoor heat exchanger 51 via the gas pipe connection portion 54 flows through the outdoor gas pipe 24 via the second stop valve 16 of the outdoor unit 2, and flows into the fourth port 12D of the four-way valve 12. The refrigerant that has flown into the fourth port 12D of the four-way valve 12 flows into the refrigerant inflow side of the accumulator 17 via the third port 12C. The refrigerant that has flown in from the refrigerant inflow side of the accumulator 17 flows in via the suction pipe 22, is sucked by the compressor 11, and is compressed again.

The acquisition unit 41 in the control circuit 19 acquires sensor values of the discharge pressure sensor 31, the discharge temperature sensor 32, the suction pressure sensor 33, the suction temperature sensor 63, the refrigerant temperature sensor 35, and the outdoor air temperature sensor 36 in the outdoor unit 2. Further, the acquisition unit 41 acquires sensor values of the liquid-side refrigerant temperature sensor 61, the gas-side temperature sensor 62, and the suction temperature sensor 63 of each of the indoor units 3.

Figure 5:
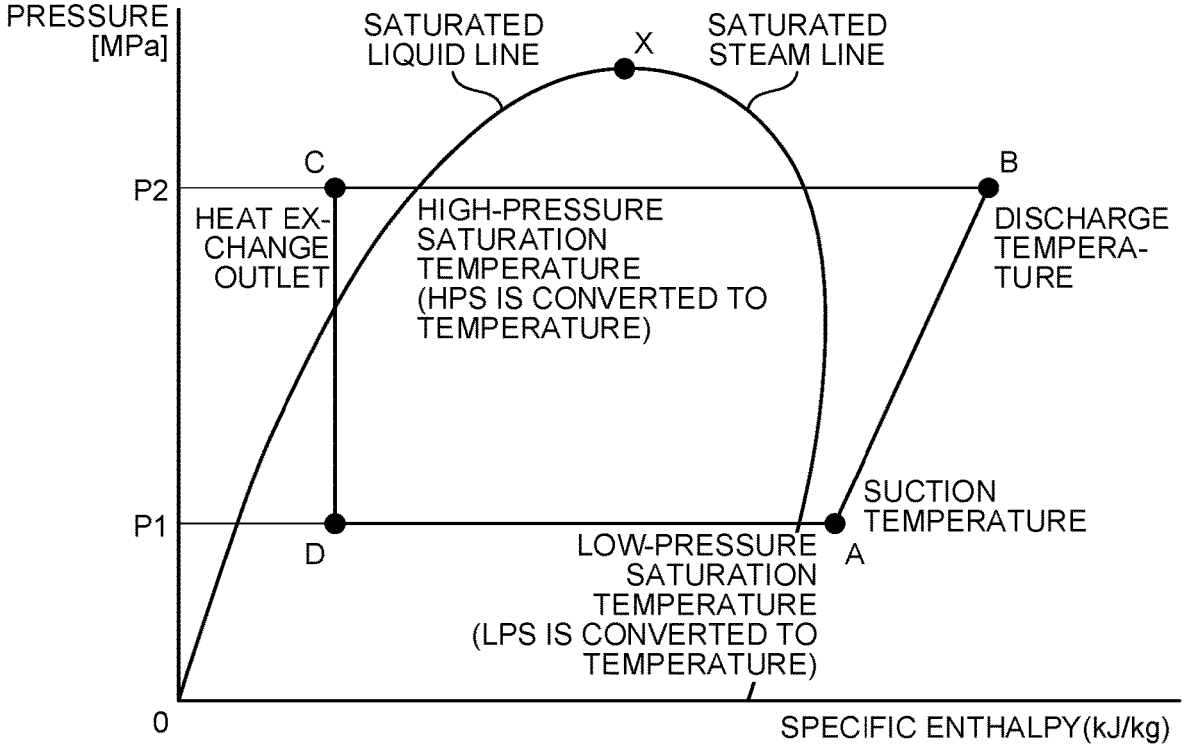
FIG. 5 is a Mollier diagram illustrating a state of a change in a refrigerant of the air conditioner.

FIG. 5 is a Mollier diagram illustrating a cooling cycle of the air conditioner 1. When the air conditioner 1 performs cooling operation, the outdoor heat exchanger 13 functions as a condenser and the indoor heat exchanger 51 functions as an evaporator. Further, when the air conditioner 1 performs heating operation, the outdoor heat exchanger 13 functions as an evaporator and the indoor heat exchanger 51 functions as a condenser.

The compressor 11 compresses a low-temperature and low-pressure gas refrigerant that flows in from the evaporator, and discharges a high-temperature and high-pressure gas refrigerant (a refrigerant in the state at a point B in FIG. 5). Meanwhile, the temperature of the gas refrigerant that is discharged from the compressor 11 is discharge temperature and the discharge temperature is detected by the discharge temperature sensor 32.

The condenser performs heat exchange between the high-temperature and high-pressure gas refrigerant coming from the compressor 11 with air, and condenses the gas refrigerant. In this case, in the condenser, the entire gas refrigerant turns into a liquid refrigerant due to a latent heat change, and thereafter, the temperature of the liquid refrigerant is reduced due to a sensible heat change, so that a supercooled state is achieved (a state at a point C in FIG. 5). Meanwhile, the temperature at which the gas refrigerant is changed to the liquid refrigerant due to the latent heat change is high-pressure saturation temperature, and the temperature of the refrigerant in the supercooled state at an outlet of the condenser is the heat exchange outlet temperature. The high-pressure saturation temperature is temperature that corresponds to a pressure value (a pressure value P2 that is represented by "HPS" in FIG. 5) that is detected by the discharge pressure sensor 31. The heat exchange outlet temperature is the temperature of the refrigerant that flows through the outdoor liquid pipe 25 and is detected by the refrigerant temperature sensor 35.

The expansion valve depressurizes the low-temperature and high-pressure refrigerant that has flown out of the condenser, so that a gas-liquid two-phase refrigerant in which gas and liquid are mixed is obtained (a refrigerant in a state at a point D in FIG. 5).

The evaporator performs heat exchange between the gas-liquid two-phase refrigerant that has flown in and air, and evaporates the refrigerant. In this case, in the evaporator, after the entire gas-liquid two-phase refrigerant turns into a gas refrigerant due to a latent heat change, temperature of the gas refrigerant increases due to a sensible heat change, so that the refrigerant enters in a superheated state (a state at a point A in FIG. 5) and is sucked into the compressor 11. Meanwhile, the temperature at which the liquid refrigerant is changed to the gas refrigerant due to the latent heat change is low-pressure saturation temperature. The low-pressure saturation temperature is temperature that corresponds to a pressure value (a pressure value P1 indicated by "LPS" in FIG. 5) that is detected by the suction pressure sensor 33. Further, the temperature of the refrigerant that is superheated by the evaporator and sucked into the compressor 11 is suction temperature. The suction temperature is detected by the suction temperature sensor 34.

Meanwhile, the degree of supercooling of the refrigerant that is in the supercooled state when the refrigerant flows out of the condenser may be calculated by subtracting the temperature (the heat exchange outlet temperature as described above) of the refrigerant at a refrigerant outlet of the heat exchanger that functions as a condenser from the high-pressure saturation temperature. Furthermore, the degree of suction superheat of the refrigerant that is in the superheated state when the refrigerant flows out of the evaporator may be calculated by subtracting the suction temperature from the low-pressure saturation temperature.

First Feature Value

FIG. 6 is an explanatory diagram illustrating examples of a first feature value that is used for the first to the third cooler estimation models 45A1, 45A2, and 45A3 and a second feature value that is used for the cooling-period abnormality estimation model 46B. The first feature value is adopted as an operating state quantity that is used for the refrigerant amount estimation model 45A. Examples of the first feature value that is used for the first to the third cooler estimation models 45A1, 45A2, and 45A3 include a rotation speed of the compressor 11, the high-pressure saturation temperature, the suction temperature, low-pressure refrigerant temperature, the degree of supercooling of refrigerant (outdoor heat exchange subcool), and the outdoor air temperature. The rotation speed of the compressor 11 is detected by a rotation speed sensor (not illustrated) of the compressor 11. The high-pressure saturation temperature is a value that is obtained by converting the pressure value detected by the discharge pressure sensor 31 to temperature. The suction temperature is detected by the suction temperature sensor 34. The low-pressure refrigerant temperature is temperature of the refrigerant that is superheated by the evaporator and sucked into the compressor 11. The degree of supercooling of the refrigerant is, for example, a value that is calculated by subtracting the outdoor heat exchange outlet temperature from the high-pressure saturation temperature. The outdoor air temperature is detected by the outdoor air temperature sensor 36. Meanwhile, the outdoor heat exchange outlet temperature is detected by the refrigerant temperature sensor 35. For example, the operating state quantity including the first feature value used for the first to the third cooler estimation models 45A1, 45A2 and 45A3 is periodically detected by a detection unit, such as the rotation speed sensor, the discharge pressure sensor 31, the suction temperature sensor 34, the outdoor air temperature sensor 36, or the refrigerant temperature sensor 35. Meanwhile, if the air conditioner 1 is operating, the control unit 44 instructs the detection unit to periodically (for example, every 10 minutes) acquires the operating state quantity. The detection unit that has received the instruction detects the operating state quantity from the various kinds of sensors that are arranged in the air conditioner 1. Acquisition time information is also given to the operating state quantity that is periodically acquired.

FIG. 7 is an explanatory diagram illustrating examples of the first feature value that is used for the first to the third heater estimation models 45A4, 45A5, and 45A6 and the second feature value that is used for the heating-period abnormality estimation model 46C. Examples of the first feature value used for the first to the third heater estimation models 45A4, 45A5, and 45A6 include the degree of opening of the outdoor unit expansion valve 14, the rotation speed of the compressor 11, the degree of suction superheat, and the outdoor air temperature. The degree of opening of the outdoor unit expansion valve 14 is the number of pulses that the control unit 44 gives to a stepping motor (not illustrated) of the outdoor unit expansion valve 14. The rotation speed of the compressor 11 is detected by the rotation speed sensor (not illustrated) of the compressor 11. The degree of suction superheat is a value that is calculated by, for example, subtracting the low-pressure saturation temperature from the suction temperature. The outdoor air temperature is detected by the outdoor air temperature sensor 36. The suction temperature is detected by the suction temperature sensor 34, and the low-pressure saturation temperature is a value that is obtained by converting the pressure value detected by the suction pressure sensor 33 to temperature. Meanwhile, for example, the operating state quantity including the first feature value that is used for the first to the third heater estimation models 45A4, 45A5 and 45A6 is periodically detected by the detection unit, such as the rotation speed sensor, the suction temperature sensor 34, or the outdoor air temperature sensor 36.

Second Feature Value

The operating state quantity that is used for the abnormality estimation model 46A includes the second feature value that is related to abnormality of the refrigerant circuit 6. The second feature value that is used to generate the abnormality estimation model 46A is a value that is obtained when, for example, the refrigerant circuit 6 is realized on the computer, numerical analysis is performed (hereinafter, performance of numerical analysis may be described as a simulation), operation of the refrigerant circuit 6 is normal, and only a remaining refrigerant amount is changed. Meanwhile, the second feature value that is used to generate the abnormality estimation model 46A will be referred to as a simulation value (may be simply referred to as a "value"). The second feature value includes at least a single operating state quantity that is included in the first feature value and a single operating state quantity that is not included in the first feature value.

Examples of the second feature value that is used for the cooling-period abnormality estimation model 46B include, as illustrated in FIG. 6, the rotation speed of the compressor 11, the high-pressure saturation temperature, the suction temperature, the low-pressure refrigerant temperature, the outdoor air temperature, a high-pressure sensor (HPS), and the heat exchange outlet temperature. The rotation speed of the compressor 11 is detected by the rotation speed sensor (not illustrated) of the compressor 11. The high-pressure saturation temperature is a value that is obtained by converting the pressure value detected by the discharge pressure sensor 31 to temperature. The suction temperature is detected by the suction temperature sensor 34. The low-pressure refrigerant temperature is temperature of the refrigerant that is superheated by the evaporator and sucked into the compressor 11. The outdoor air temperature is detected by the outdoor air temperature sensor 36. The high-pressure sensor is a pressure value that is detected by the discharge pressure sensor 31. The heat exchange outlet temperature is detected by the refrigerant temperature sensor 35. Meanwhile, for example, the operating state quantity including the second feature value that is used for the cooling-period abnormality estimation model 46B is periodically detected by the detection unit, such as the rotation speed sensor, the discharge pressure sensor 31, the suction temperature sensor 34, the outdoor air temperature sensor 36, or the refrigerant temperature sensor 35.

Further, examples of the second feature value that is used for the heating-period abnormality estimation model 46C include, as illustrated in FIG. 7, the degree of opening of the outdoor unit expansion valve 14, the rotation speed of the compressor 11, the outdoor air temperature, the discharge temperature, the suction temperature, the low-pressure saturation temperature, and a low-pressure sensor (LPS). The degree of opening of the outdoor unit expansion valve 14 is detected by a sensor (not illustrated). The rotation speed of the compressor 11 is detected by the rotation speed sensor (not illustrated) of the compressor 11. The outdoor air temperature is detected by the outdoor air temperature sensor 36. The discharge temperature is detected by the discharge temperature sensor 32. The suction temperature is detected by the suction temperature sensor 34. The low-pressure saturation temperature is a value that is obtained by converting the pressure value detected by the suction pressure sensor 33 to temperature. The low-pressure sensor is the pressure value that is detected by the suction pressure sensor 33. Meanwhile, for example, the operating state quantity including the second feature value that is used for the heating-period abnormality estimation model 46C is periodically detected by the detection unit, such as the rotation speed sensor, the suction temperature sensor 34, the outdoor air temperature sensor 36, or the suction pressure sensor 33.

The second feature value that is commonly used between the cooling-period abnormality estimation model 46B and the heating-period abnormality estimation model 46C includes the rotation speed of the compressor 11 and the suction temperature that are the operating state quantities at the side of the outdoor unit 2.

Further, the second feature value that is commonly used between the cooling-period abnormality estimation model 46B and the heating-period abnormality estimation model 46C includes the operating state quantity at the side of the indoor unit 3; for example, heat exchange inlet temperature at the side of the indoor unit (detected by the liquid-side refrigerant temperature sensor 61 and detected by the gas-side temperature sensor 62 at the time of heating operation), the heat exchange outlet temperature at the side of the indoor unit (detected by the gas-side temperature sensor 62 at the time of cooling operation and detected by the liquid-side refrigerant temperature sensor 61 at the time of heating operation), and the degree of opening of the indoor unit expansion valve 52. Meanwhile, as the second feature value at the side of the indoor unit 3, for example, the heat exchange inlet temperature at the side of the indoor unit, the heat exchange outlet temperature at the side of the indoor unit, and the degree of opening of the indoor unit expansion valve 52 are illustrated, but it is possible to acquire the feature value in the same manner even if the indoor unit 3 is of a different type, such as a duct type or a ceiling cassette type.

Configuration of Refrigerant Amount Estimation Model

The refrigerant amount estimation model 45A is generated by using a detected value of the first feature value. The refrigerant amount estimation unit 45 estimates a refrigerant shortage rate of the refrigerant circuit 6 by applying the detected value of the first feature value, which is acquired at a timing different from a timing of generation of the refrigerant amount estimation model 45A, to the refrigerant amount estimation model 45A.

The refrigerant amount estimation model 45A is generated by a multiple regression analysis method that is one of regression analysis methods by using an arbitrary operating state quantity (the detected value of the first feature value) among the plurality of operating state quantities. In the multiple regression analysis method, the refrigerant amount estimation model 45A is generated by selecting a regression equation, in which a P value (a value that indicates a degree of influence of the operating state quantity on accuracy of the generated estimation model (predetermined weight parameter)) is minimized and a correction value R2 (a value that indicates accuracy of the generated refrigerant amount estimation model 45A) is maximized in a range from 0.9 to 1.0, from among regression equations that are obtained from a plurality of simulation results (results obtained by reproducing the refrigerant circuit 6 by a numerical calculation and calculating values of the operating state quantities with respect to the remaining refrigerant amount). Here, the P value and the correction value R2 are values that are related to accuracy of the refrigerant amount estimation model 45A when the refrigerant amount estimation model 45A is generated by the multiple regression analysis method, and the accuracy of the generated refrigerant amount estimation model 45A increases as the P value decreases and as the correction value R2 approaches 1.0. As a result, if the refrigerant shortage rate is 0% to 30% at the time of cooling, for example, the operating state quantities, such as the degree of supercooling of the refrigerant, the outdoor air temperature, the high-pressure saturation temperature, and the rotation speed of the compressor 11, are adopted as the first feature values. If the refrigerant shortage rate is 40% to 70% at the time of cooling, for example, the operating state quantities, such as the suction temperature, the outdoor air temperature, and the rotation speed of the compressor 11, are adopted as the first feature values. If the refrigerant shortage rate at the time of heating is 0% to 20%, for example, the operating state quantity, such as the degree of opening of the outdoor unit expansion valve 14, is adopted as the feature value. Further, if the refrigerant shortage rate at the time of heating is 30% to 70%, for example, the operating state quantities, such as the degree of suction superheat (the suction temperature-the low-pressure saturation temperature), the outdoor air temperature, the rotation speed of the compressor 11, and the degree of opening of the outdoor unit expansion valve 14, are adopted as the first feature values.

The refrigerant amount estimation model 45A includes the first cooler estimation model 45A1, the second cooler estimation model 45A2, the third cooler estimation model 45A3, the first heater estimation model 45A4, the second heater estimation model 45A5, and the third heater estimation model 45A6 as described above. In the present embodiment, each of the estimation models as described above is generated by using a simulation result to be described later, and is stored in the refrigerant amount estimation unit 45 in the control circuit 19 of the air conditioner 1 in advance.

The first cooler estimation model 45A1 is the refrigerant amount estimation model 45A that is effective when the refrigerant shortage rate is 0% to 30% (first range), and is a first regression equation that is able to estimate the refrigerant shortage rate with high accuracy. The first regression equation is, for example, ($\alpha$1×the degree of supercooling of the refrigerant)+($\alpha$2×the outdoor air temperature)+($\alpha$3×the high-pressure saturation temperature)+($\alpha$4×the rotation speed of the compressor 11)+$\alpha$5. It is assumed that the coefficients $\alpha$1 to $\alpha$5 are determined when the estimation models are generated. The refrigerant amount estimation unit 45 calculates the refrigerant shortage rate of the refrigerant circuit 6 at a current time by assigning the degree of supercooling of the refrigerant, the outdoor air temperature, the high-pressure saturation temperature, and the rotation speed of the compressor 11 at the current time, which are acquired by the acquisition unit 41, to the first regression equation. Meanwhile, the reason that the degree of supercooling of the refrigerant, the outdoor air temperature, the high-pressure saturation temperature, and the rotation speed of the compressor 11 are assigned is to use the first feature values that are used to generate the first cooler estimation model 45A1. The degree of supercooling of the refrigerant can be calculated by, for example, subtracting the heat exchange outlet temperature from the high-pressure saturation temperature. The outdoor air temperature is detected by the outdoor air temperature sensor 36. The high-pressure saturation temperature is a value that is obtained by converting the pressure value detected by the discharge pressure sensor 31 to temperature. The rotation speed of the compressor 11 is detected by the rotation speed sensor (not illustrated) of the compressor 11.

The second cooler estimation model 45A2 is the refrigerant amount estimation model 45A that is effective when the refrigerant shortage rate is 40% to 70% (second range), and is a second regression equation that is able to estimate the refrigerant shortage rate with high accuracy. The second regression equation is, for example, ($\alpha$11×the suction temperature)+($\alpha$12×the outdoor air temperature)+($\alpha$13×the rotation speed of the compressor 11)+$\alpha$14. It is assumed that the coefficients $\alpha$11 to $\alpha$14 are determined when the estimation model is generated. The refrigerant amount estimation unit 45 calculates the refrigerant shortage rate of the refrigerant circuit 6 at a current time by assigning the suction temperature, the outdoor air temperature, and the rotation speed of the compressor 11 at the current time, which are acquired by the acquisition unit 41, to the second regression equation. Meanwhile, the reason that the suction temperature, the outdoor air temperature, and the rotation speed of the compressor 11 are assigned is to use the feature values that are used to generate the second cooler estimation model 45A2. The suction temperature is detected by the suction temperature sensor 34. The outdoor air temperature is detected by the outdoor air temperature sensor 36. The rotation speed of the compressor 11 is detected by the rotation speed sensor (not illustrated) of the compressor 11.

Figure 8A:
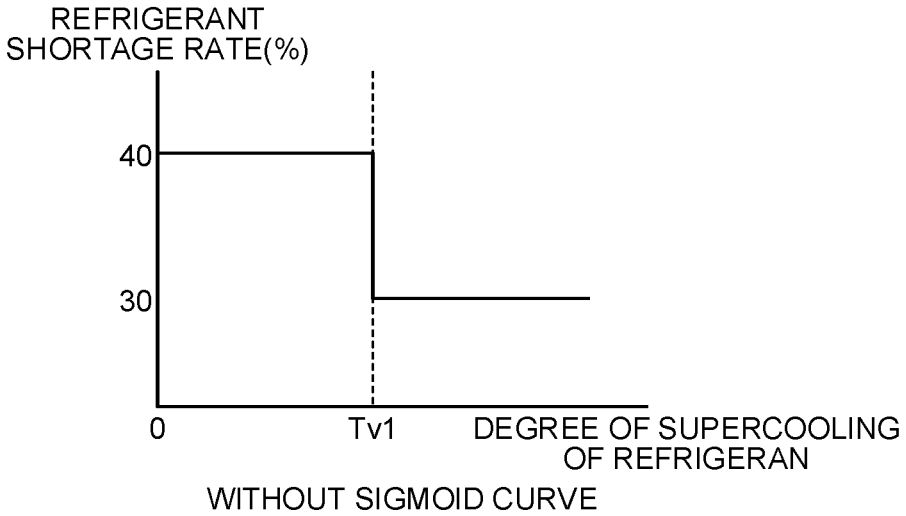
FIG. 8A is an explanatory diagram illustrating an example in which an estimation result obtained by the first cooler estimation model and an estimation result obtained by the second cooler estimation model are not interpolated by a sigmoid curve.

Meanwhile, as described above, the refrigerant shortage rate that can be obtained by the first regression equation is 0% to 30%, and the refrigerant shortage rate that can be obtained by the second regression equation is 40% to 70%. In this case, when the refrigerant shortage rate is 30% to 40%, and if the first regression equation is used, the refrigerant shortage rate is calculated as 30%, whereas if the second regression equation is used, the refrigerant shortage rate is calculated as 40%. In other words, if the refrigerant shortage rate is 30% to 40%, both of the degree of supercooling of the refrigerant, which is highly contributable when the refrigerant shortage rate is equal to or smaller than 30%, and the suction temperature, which is highly contributable when the refrigerant shortage rate is equal to or larger than 40%, are less likely to change, so that it is difficult to generate an effective estimation model. Therefore, if the first regression equation or the second regression equation is used, the refrigerant shortage rate largely differs depending on the model to be used as illustrated in FIG. 8A.

Figure 8B:
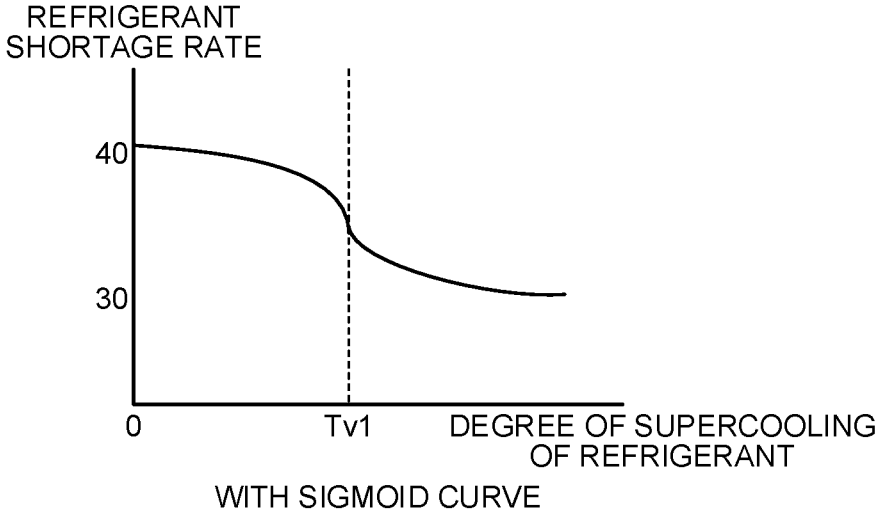
FIG. 8B is an explanatory diagram illustrating an example in which the estimation result obtained by the first cooler estimation model and the estimation result obtained by the second cooler estimation model are interpolated by a sigmoid curve.

The third cooler estimation model 45A3 is a cooling-period refrigerant shortage rate calculation formula that can cover the refrigerant shortage rate in a range of 0% to 70% that includes a range in which it is difficult to estimate the refrigerant shortage rate by using any of the first regression equation and the second regression equation as described above. As illustrated in FIG. 8B, the cooling-period refrigerant shortage rate calculation formula continuously connects a refrigerant shortage rate that is an estimation result obtained by the first regression equation and a refrigerant shortage rate that is an estimation result obtained by the second regression equation, by a sigmoid curve using a sigmoid coefficient. Specifically, the cooling-period refrigerant shortage rate calculation formula is (the sigmoid coefficient×the refrigerant shortage rate obtained by the first regression equation)+((1−the sigmoid coefficient)×the refrigerant shortage rate obtained by the second regression equation). The refrigerant amount estimation unit 45 calculates the refrigerant shortage rate of the refrigerant circuit 6 at a current time by assigning each of the refrigerant shortage rates, which are calculated by assigning the current operating state quantities that are acquired by the acquisition unit 41 to the first regression equation and the second regression equation, to the cooling-period refrigerant shortage rate calculation formula.

Here, the sigmoid coefficient is calculated by using any of the operating state quantities. In the present embodiment, by taking into account the fact that a result obtained by the first regression equation becomes approximately constant if the subcool reaches 0, a calculation formula is determined such that the sigmoid coefficient is 0.5 when the subcool is 5° C.

$$p=1/(1+\exp(-(sc-5)))$$

p: sigmoid coefficient sc: subcool value

If the sigmoid coefficient is determined as described above and the sigmoid coefficient is used for the third cooler estimation model 45A3, the estimated value of the first cooler estimation model 45A1 is dominant in the estimated value obtained by the third cooler estimation model 45A3 when the refrigerant shortage rate is 0% to 30%, that is, when the refrigerant shortage rate is in the first range, and, the estimated value of the second cooler estimation model 45A2 is dominant in the estimated value obtained by the third cooler estimation model 45A3 when the refrigerant shortage rate is 40% to 70%, that is, when the refrigerant shortage rate is in the second range.

Meanwhile, the sigmoid coefficient need not always be calculated by the method as described above, but it is sufficient to determine the sigmoid coefficient such that when an actual refrigerant shortage rate is equal to or larger than 30%, that is, when the actual refrigerant shortage rate does not fall in the first range, the estimated value of the second cooler estimation model 45A2 becomes dominant in the estimated value obtained by the third cooler estimation model 45A3, and when the actual refrigerant shortage rate is equal to or smaller than 40%, that is, when the actual refrigerant shortage rate does not fall in the second range, the estimated value of the first cooler estimation model 45A1 becomes dominant in the estimated value obtained by the third cooler estimation model 45A3.

The first heater estimation model 45A4 is the refrigerant amount estimation model 45A that is effective when the refrigerant shortage rate is 0% to 20% (third range), and is a fourth regression equation that is able to estimate the refrigerant shortage rate with high accuracy. The fourth regression equation is, for example, (α31×the degree of opening of the outdoor unit expansion valve 14)+α32. The refrigerant amount estimation unit 45 calculates the refrigerant shortage rate by assigning the current degree of opening of the outdoor unit expansion valve 14 acquired by the acquisition unit 41 to the fourth regression equation. Meanwhile, the reason that the degree of opening of the outdoor unit expansion valve 14 is assigned is to use the feature value that is used to generate the first heater estimation model 45A4.

The second heater estimation model 45A5 is the refrigerant amount estimation model 45A that is effective when the refrigerant shortage rate is 30% to 70% (fourth range), and is a fifth regression equation that is able to estimate the refrigerant shortage rate with high accuracy. The fifth regression equation is, for example, (α41×the degree of suction superheat)+(α42×the outdoor air temperature)+(α43×the rotation speed of the compressor 11)+(α44×the degree of opening of the outdoor unit expansion valve 14)+α45. The coefficients α41 to α45 are determined when the estimation models are generated. The refrigerant amount estimation unit 45 calculates the refrigerant shortage rate of the refrigerant circuit 6 at a current time by assigning the degree of suction superheat, the outdoor air temperature, the rotation speed of the compressor 11, and the degree of opening of the expansion valve on the main side at the current time, which are acquired by the acquisition unit 41, to the fifth regression equation. Meanwhile, the reason that the degree of suction superheat, the outdoor air temperature, the rotation speed of the compressor 11, and the degree of opening of the outdoor unit expansion valve 14 are assigned is to use the feature values that are used to generate the second heater estimation model 45A5. The degree of suction superheat can be calculated by, for example, subtracting the low-pressure saturation temperature from the suction temperature. The outdoor air temperature is detected by the outdoor air temperature sensor 36. The rotation speed of the compressor 11 is detected by the rotation speed sensor (not illustrated)

of the compressor 11. The degree of opening of the outdoor unit expansion valve 14 is calculated by a sensor (not illustrated).

Figure 9A:
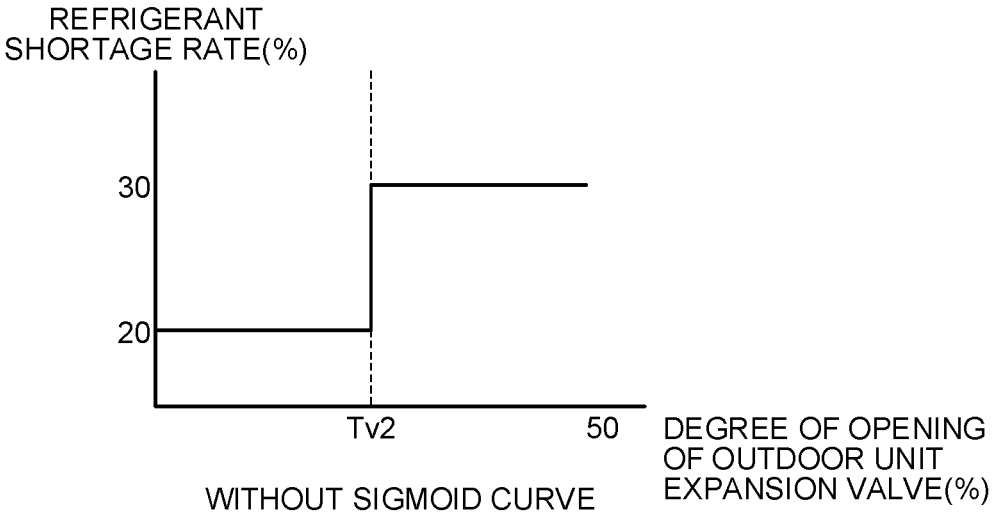
FIG. 9A is an explanatory diagram illustrating an example in which an estimation result obtained by the first heater estimation model and an estimation result obtained by the second heater estimation model are not interpolated by a sigmoid curve.

Further, as described above, the refrigerant shortage rate that can be obtained by the fourth regression equation is 0% to 20%, and the refrigerant shortage rate that can be obtained by the fifth regression equation is 30% to 70%. In this case, when the refrigerant shortage rate is 20% to 30%, and if the fourth regression equation is used, the refrigerant shortage rate is calculated as 20%, whereas if the fifth regression equation is used, the refrigerant shortage rate is calculated as 30%. In other words, if the refrigerant shortage rate is 20% to 30%, both of the degree of opening of the outdoor unit expansion valve 14, which is highly contributable when the refrigerant shortage rate is equal to or smaller than 20%, and the degree of suction superheat, which is highly contributable when the refrigerant shortage rate is equal to or larger than 30%, are less likely to change, so that it is difficult to generate an effective estimation model. Therefore, if the fourth regression equation or the fifth regression equation is used, the refrigerant shortage rate largely differs depending on the model to be used as illustrated in FIG. 9A.

Figure 9B:
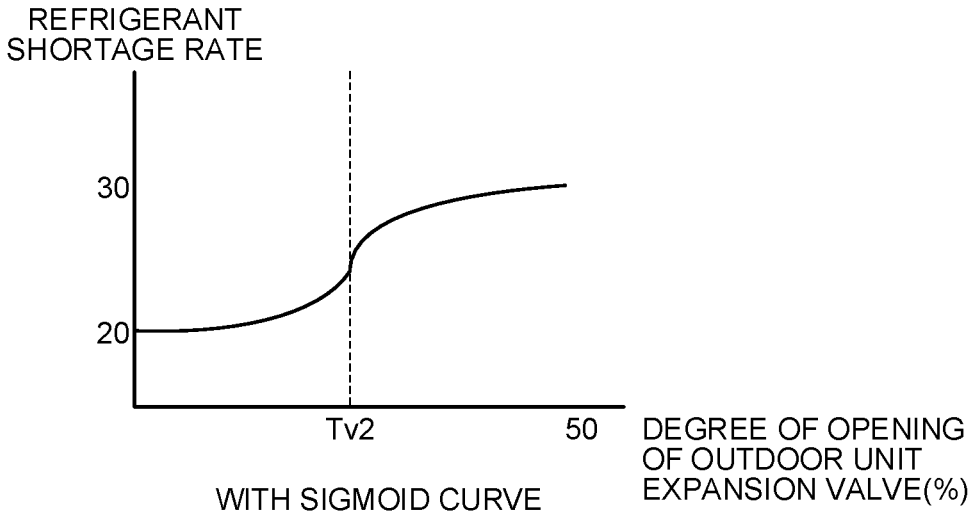
FIG. 9B is an explanatory diagram illustrating an example in which the estimation result obtained by the first heater estimation model and the estimation result obtained by the second heater estimation model are interpolated by a sigmoid curve.

The third heater estimation model 45A6 is a heating-period refrigerant shortage rate calculation formula that can cover the refrigerant shortage rate in a range from 0% to 70% that includes a range in which it is difficult to estimate the refrigerant shortage rate by using any of the fourth regression equation and the fifth regression equation as described above. As illustrated in FIG. 9B, the heating-period refrigerant shortage rate calculation formula continuously connects a refrigerant shortage rate that is an estimation result obtained by the fourth regression equation and a refrigerant shortage rate that is an estimation result obtained by the refrigerant shortage rate, by a sigmoid curve using a sigmoid coefficient. Specifically, the heating-period refrigerant shortage rate calculation formula is (the sigmoid coefficient×the refrigerant shortage rate obtained by the fifth regression equation)+((1−the sigmoid coefficient)×the refrigerant shortage rate obtained by the fourth regression equation). The refrigerant amount estimation unit 45 calculates the refrigerant shortage rate of the refrigerant circuit 6 at a current time by assigning each of the refrigerant shortage rates, which are calculated by assigning the current operating state quantities that are acquired by the acquisition unit 41 to the fourth regression equation and the fifth regression equation, to the heating-period refrigerant shortage rate calculation formula.

Here, the sigmoid coefficient is calculated by using any of the operating state quantities, in the same manner as in the cooling operation. In the present embodiment, by taking into account the fact that a result obtained by the fourth regression equation becomes approximately constant if the degree of opening of the outdoor unit expansion valve 14 is set to full-open based on the assumption that a fully-closed state is indicated by 0 and a fully-opened state is indicated by 100, a calculation formula is determined such that the sigmoid coefficient is 0.5 when the degree of opening of the outdoor unit expansion valve 14 is 90.

$$p=1/(1+\exp(-(D/10-45)))$$

p: sigmoid coefficient

D: degree of opening of the outdoor unit expansion valve 14

If the sigmoid coefficient is determined as described above and the sigmoid coefficient is used for the third heater estimation model 45A6, the estimated value of the first heater estimation model 45A4 is dominant in the estimated value obtained by the third heater estimation model 45A6 when the refrigerant shortage rate is 0% to 20%, that is, when the refrigerant shortage rate is in the third range, and, the estimated value of the second heater estimation model 45A5 is dominant in the estimated value obtained by the third heater estimation model 45A6 when the refrigerant shortage rate is 30% to 70%, that is, when the refrigerant shortage rate is in the fourth range.

Meanwhile, the sigmoid coefficient need not always be calculated by the method as described above, but it is sufficient to determine the sigmoid coefficient such that when an actual refrigerant shortage rate is equal to or larger than 20%, that is, when the actual refrigerant shortage rate does not fall in the third range, the estimated value of the second heater estimation model 45A5 becomes dominant in the estimated value obtained by the third heater estimation model 45A6, and when the actual refrigerant shortage rate is equal to or smaller than 30%, that is, when the actual refrigerant shortage rate does not fall in the fourth range, the estimated value of the first heater estimation model 45A4 becomes dominant in the estimated value obtained by the third heater estimation model 45A6.

As described above, the refrigerant shortage rate is estimated by using the first regression equation, the second regression equation, and the cooling-period refrigerant shortage rate calculation formula at the time of cooling operation. If a value of the degree of supercooling of the refrigerant at the time of cooling is larger than a first threshold (Tv1 in FIG. 8A and FIG. 8B), it is possible to estimate the refrigerant shortage rate with increased accuracy by selecting the first regression equation rather than selecting the second regression equation. Further, if the value of the degree of supercooling of the refrigerant at the time of cooling is smaller than the first threshold, it is possible to estimate the refrigerant shortage rate with increased accuracy by selecting the second regression equation rather than selecting the first regression equation. Furthermore, if the value of the degree of supercooling of the refrigerant at the time of cooling is around the first threshold, the estimated value of the refrigerant shortage rate largely differs depending on the regression equation to be used. Therefore, at the time of cooling, the cooling-period refrigerant shortage rate calculation formula that includes the first regression equation and the second regression equation is selected. With this configuration, it is possible to estimate the refrigerant shortage rate at the time of cooling with high accuracy.

Moreover, the refrigerant shortage rate is estimated by using the fourth regression equation, the fifth regression equation, and the heating-period refrigerant shortage rate calculation formula at the time of heating operation. If the degree of opening of the outdoor unit expansion valve 14 at the time of heating is smaller than a second threshold (Tv2 in FIG. 9A and FIG. 9B), it is possible to estimate the refrigerant shortage rate with increased accuracy by selecting the fourth regression equation rather than selecting the fifth regression equation. Further, if the degree of opening of the outdoor unit expansion valve 14 at the time of heating is not smaller than the second threshold, it is possible to estimate the refrigerant shortage rate with increased accuracy by selecting the fifth regression equation rather than selecting the fourth regression equation. Furthermore, if a value of the degree of opening of the outdoor unit expansion valve 14 is around the second threshold, the estimated value of the refrigerant shortage rate largely differs depending on the regression equation to be used. Therefore, at the time of heating, the heating-period refrigerant shortage rate calculation formula that includes the fourth regression equation and the fifth regression equation is selected. With this configuration, it is possible to estimate the refrigerant shortage rate at the time of heating with high accuracy.

Configuration of Abnormality Estimation Model

The abnormality estimation model 46A is generated by using a simulation value that is a value of the second feature value that is obtained as a result of a simulation of operation of the refrigerant circuit when the refrigerant circuit 6 operates normally and when only the remaining refrigerant amount is changed. The abnormality estimation unit 46 estimates whether the detected value of the second feature value of each of the pairs P1 to P4 is abnormal or normal by applying the detected value of the second feature value of each of the pairs P1 to P4 acquired from the operating air conditioner 1 to the abnormality estimation model 46A. Specifically, if the detected value of the second feature value of each of the pairs P1 to P4 is abnormal, the abnormality estimation unit 46 estimates that abnormality has occurred in the refrigerant circuit 6 of each of the pairs P1 to P4. If the detected value of the second feature value of each of the pairs P1 to P4 is normal, the abnormality estimation unit 46 estimates that the refrigerant circuit 6 of each of the pairs P1 to P4 is normal.

To generate the abnormality estimation model 46A, for example, a Kernel density estimation method is adopted. The Kernel density estimation method is a method of estimating an entire distribution from limited sample points. The abnormality estimation model 46A calculates a degree of deviation (hereinafter, may also be referred to as an outlier) from a local maximum value (a center of a cluster (a set of data having similarities)) of a density function, based on the density function of the entire distribution that is estimated from the limited sample points. Further, if determination target data is input, the abnormality estimation model 46A calculates an outlier of the data and determines whether the outlier falls within a predetermined range or not (whether the determination target data is included in the cluster).

Figure 10:
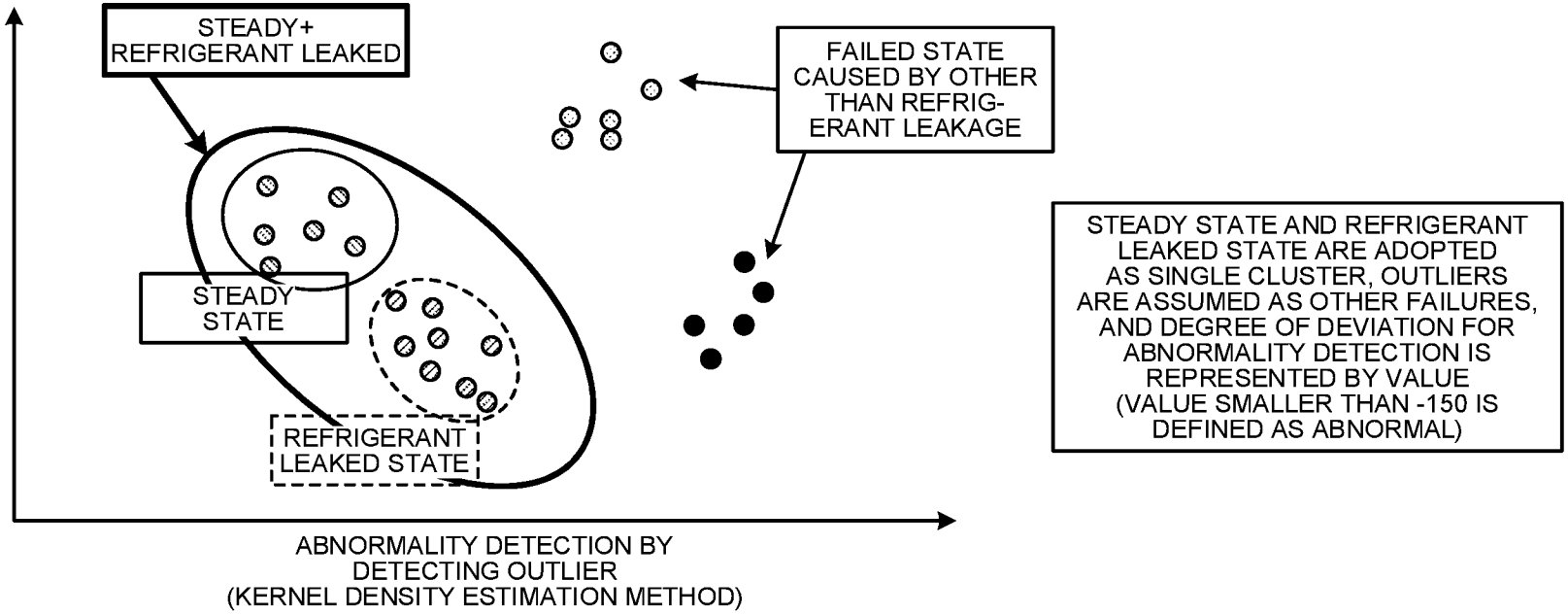
FIG. 10 is an explanatory diagram illustrating an example of the way of distribution of detected values of the second feature values of the abnormality estimation model.

FIG. 10 is an explanatory diagram illustrating an example of the way of distribution of detected values of the second feature values of the abnormality estimation model 46A. As illustrated in FIG. 10, the abnormality estimation model 46A adopts, as a single cluster, a set of values of the second feature values (hereinafter, also referred to as "simulation values of the second feature values") that are obtained by a simulation in a steady state and a refrigerant leaked state while the refrigerant circuit 6 is in a normal state, and classifies this cluster as normal. The detected values of the second feature values in the steady state are detected values of the second feature values that are obtained by a simulation of operation of the normal refrigerant circuit 6. A condition for the simulation is the steady state while the refrigerant circuit 6 is in the normal state or the state in which a refrigerant storage amount is reduced (the refrigerant leaked state). The simulation values of the second feature values in the normal state are values of the second feature values that are obtained by a simulation that is performed by assuming a state in which each of the components (the refrigerant circuit 6, the compressor, the expansion valve, and the like) included in the air conditioner 1 operates normally. Further, the simulation values of the second feature values in the refrigerant leaked state are values of the second feature values that are obtained by a simulation that is performed by assuming a state in which each of the components (the refrigerant circuit 6, the compressor, the expansion valve, and the like) included in the air conditioner operates normally and by assuming a state in which only an amount of the refrigerant remaining in the refrigerant circuit 6 is changed (reduced). Furthermore, if a detected value of the second feature value that deviates from the cluster that is classified as normal by the abnormality estimation model 46A is input, the detected value is classified as abnormal. Meanwhile, the detected value that is classified as abnormal is a detected value that deviates from the cluster that is classified as normal when the detected value is plotted on a graph as illustrated in FIG. 10. Moreover, abnormal indicates a state in which a failure is highly likely to have occurred in a device included in the refrigerant circuit 6.

The abnormality estimation model 46A quantifies a difference between the value of the second feature value that is obtained by the simulation in the steady state and the refrigerant leaked state while the refrigerant circuit 6 is in the normal state and the detected value of the second feature value of each of the pairs P1 to P4 that is acquired from the operating air conditioner 1, and calculates an outlier. Specifically, the abnormality estimation model 46A adopts, as normal sample values (the cluster that is classified as normal), the values of the second feature values that are used to generate the abnormality estimation model 46A, and calculates an outlier that indicates a degree of deviation from the normal sample values, for the detected values of the second feature values of each of the pairs that are acquired by the acquisition unit 41 of the operating air conditioner 1. The outlier is obtained by quantifying a distance that indicates a degree of deviation from a boundary of the cluster that is classified as normal, and the degree of deviation increases with an increase in an absolute value of the quantified value. With an increase in the degree of deviation, the possibility that the detected value of the second feature value is abnormal increases.

Figure 11:
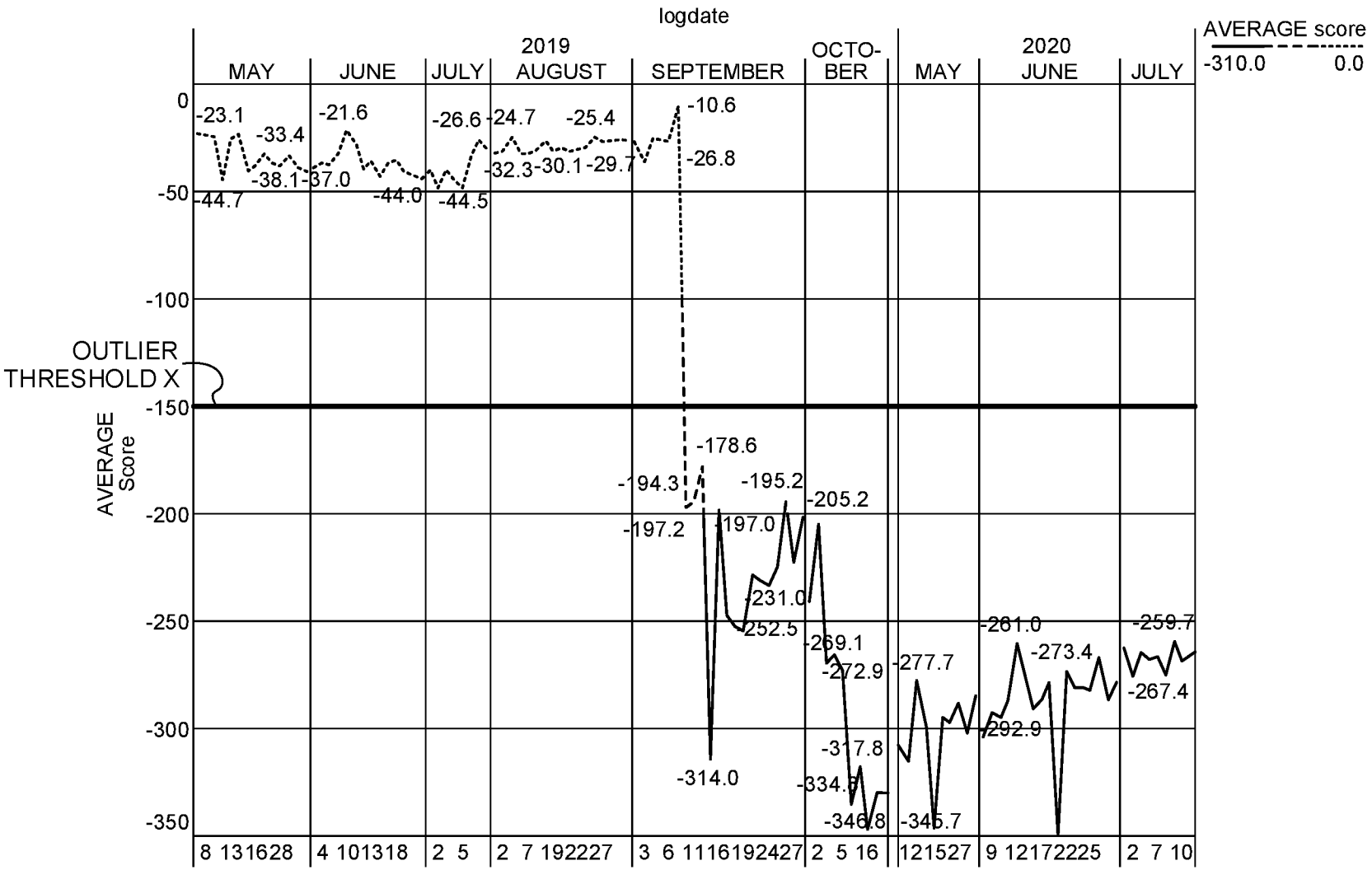
FIG. 11 is an explanatory diagram illustrating an example of abnormality detection by an outlier.

FIG. 11 is an explanatory diagram illustrating an example of abnormality detection by the outlier. The abnormality estimation unit 46 classifies the detected value of the second feature value as normal if the absolute value of the outlier of the detected value of the second feature value is, for example, smaller than an absolute value of "−150", and classifies the detected value of the second feature value as abnormal if the absolute value of the outlier of the detected value of the second feature value is, for example, equal to or larger than the absolute value of "−150". Meanwhile, an outlier threshold X is set to a certain value by which normal data is not erroneously detected as abnormal, based on a result of verification of values that are actually determined as abnormal in a collected failure history of the air conditioner 1. If the absolute value of the calculated outlier is equal to or larger than the absolute value of the outlier threshold X, the abnormality estimation unit 46 classifies the detected value of the second feature value as abnormal.

If the detected value of the second feature value is classified as abnormal, the abnormality estimation unit 46 does not cause the refrigerant amount estimation unit 45 to perform operation of estimating the refrigerant shortage rate by using the detected value of the first feature value that is detected at the same time as the detected value of the second feature value. Further, the abnormality estimation unit 46 stores the detected value of the second feature value that is classified as abnormal in the abnormality log storage unit 43A as an abnormality log.

If the absolute value of the estimated outlier is smaller than the absolute value of the outlier threshold X, the abnormality estimation unit 46 classifies the detected value of the second feature value as normal. In this case, the abnormality estimation unit 46 causes the refrigerant amount estimation unit 45 to perform operation of estimating the refrigerant shortage rate by using the detected value of the first feature value that is detected at the same time as the detected value of the second feature value. Meanwhile, the abnormality estimation unit 46 classifies the detected value of the second feature value as normal when only the refrigerant leaked state is changed.

Meanwhile, for convenience of explanation, the case has been descried in which the outlier threshold X is set to, for example, "−150", but the threshold may be adjusted appropriately based on the result of verification of the values that are actually determined as abnormal in the collected failure history.

FIG. 12 is an explanatory diagram illustrating an example of a determination result of the determination unit 46D. The abnormality estimation unit 46 outputs an estimation result in which the detected value of the second feature value of each of the pairs P1 to P4 is classified as abnormal or normal. The determination unit 46D stores the detected value of the second feature value of each of the pairs P1 to P4. The determination unit 46D determines whether the estimation results of the detected values of the second feature value of the pairs P1 to P4 include abnormality. When the detected value of the second feature value of each of the pairs P1 to P4 is abnormal, and, for example, if the detected values of the second feature values of all of the pairs P1 to P4 are abnormal, the determination unit 46D determines that the abnormality of the refrigerant circuit 6 is caused by the outdoor unit 2 that is shared by all of the pairs P1 to P4. When the detected value of the second feature value of each of the pairs P1 to P4 is abnormal, and if the detected value of the second feature value of only a certain pair is abnormal, the determination unit 46D determines that the abnormality of the refrigerant circuit 6 is caused by the indoor unit 3 in the certain pair in which the abnormality has occurred.

In FIG. 12, for example, if the detected values of the second feature values of the pairs P1, P2 and P4 are normal and the detected value of the second feature value of the pair P3 is abnormal, the determination unit 46D determines that the abnormality of the refrigerant circuit 6 is caused by the indoor unit 3C of the pair P3. Further, although not illustrated in FIG. 12, for example, if the detected values of the second feature values of the pair P1 and the pair P2 are normal and the detected values of the second feature values of the pair 3 and the pair 4 are abnormal, the determination unit 46D determines that the abnormality of the refrigerant circuit 6 is caused by the indoor unit 3C of the pair P3 and the indoor unit 3D of the pair P4.

Operation of Estimation Process

Figure 13:
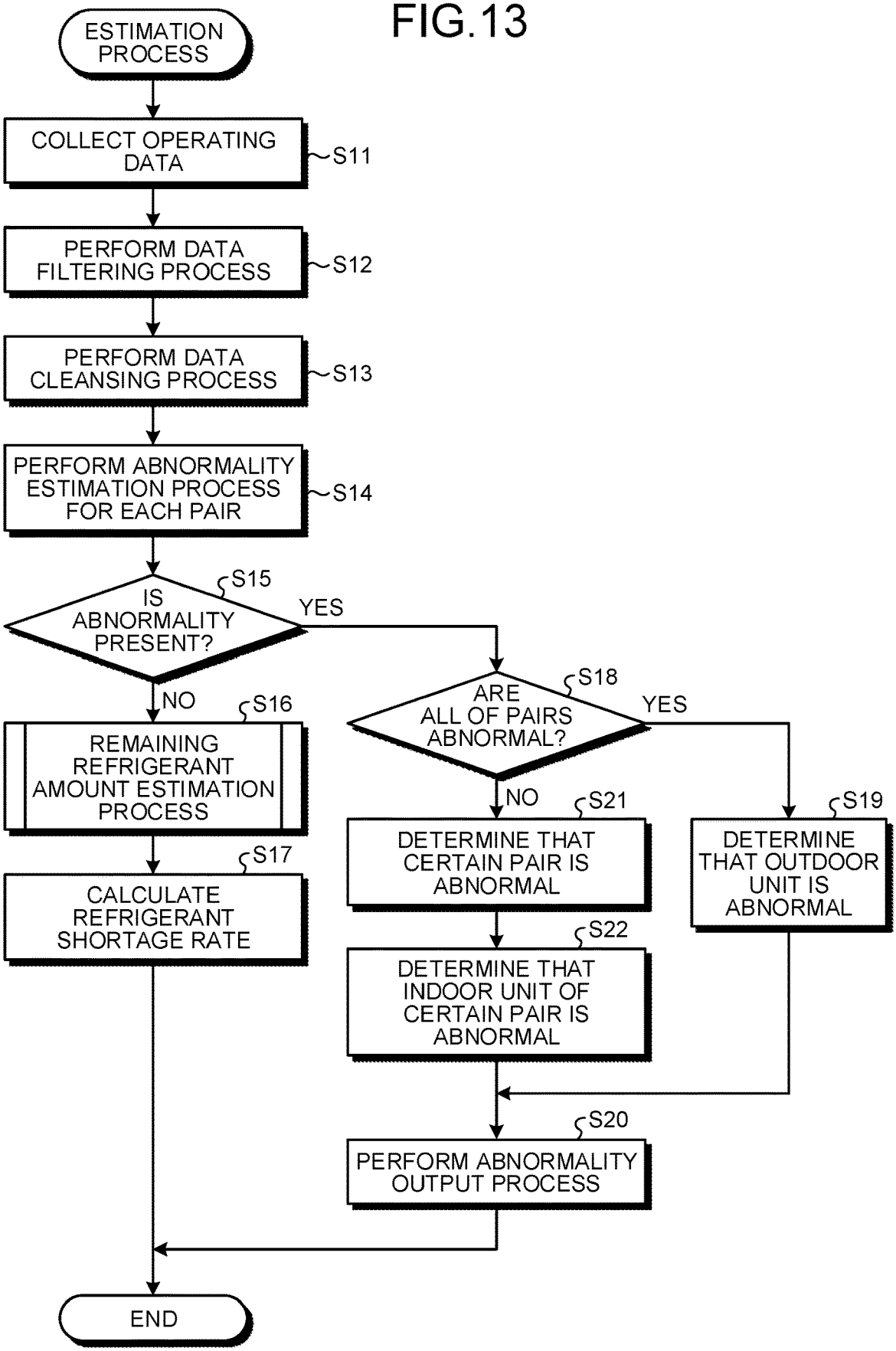
FIG. 13 is a flowchart illustrating an example of processing operation performed by a control circuit related to an estimation process.

FIG. 13 is a flowchart illustrating an example of processing operation performed by the control circuit 19 in relation to the estimation process. Meanwhile, it is assumed that the refrigerant amount estimation unit 45 in the control circuit 19 stores therein the first cooler estimation model 45A1, the second cooler estimation model 45A2, the third cooler estimation model 45A3, the first heater estimation model 45A4, the second heater estimation model 45A5, and the third heater estimation model 45A6 that are generated in advance. Further, it is assumed that the abnormality estimation unit 46 in the control circuit 19 stores therein the cooling-period abnormality estimation model 46B and the heating-period abnormality estimation model 46C that are generated in advance. The estimation process is periodically performed once in a predetermined time period (for example, night time) in one day with respect to operating state quantities that are sequentially detected every 10 minutes in 24 hours by the detection unit. Meanwhile, the night time is described as an example of the predetermined time period; however, for example, the operating state quantities corresponding to one day are acquired after operation of the air conditioner 1 is stopped in the night time that is a time period in which operating frequency of the air conditioner 1 is low. Further, as the predetermined time period, it is possible to determine a predetermined time in which operation is not performed, rather than the night time, by examining operating states of the air conditioner 1 for one month, for example.

In FIG. 13, the control unit 44 in the control circuit 19 collects the operating state quantities as pieces of operating data via the acquisition unit 41 (Step S11). The control unit 44 performs a data filtering process for extracting an arbitrary operating state quantity from among the collected pieces of operating data (Step S12). The control unit 44 performs a data cleansing process (Step S13). Further, the abnormality estimation unit 46 performs an abnormality estimation process for each of the pairs P1 to P4 for classifying whether the detected value of the second feature value that is subjected to the data cleansing process using the abnormality estimation model 46A is normal or abnormal (Step S14). In the abnormality estimation process, a classification result indicating abnormal or normal is estimated for each of the pairs P1 to P4 by using the abnormality estimation model 46A.

The control unit 44 determines whether the detected value of the second feature value of each of the pairs P1 to P4 is abnormal (Step S15). If the detected value of the second feature value of each of the pairs P1 to P4 is not abnormal (Step S15: No), the abnormality estimation unit 46 performs a remaining refrigerant amount estimation process of applying the detected value of the first feature value, which is acquired at the same time as the detected value of the second feature value of a pair that is classified as normal, to each of the refrigerant amount estimation models (Step S16). Further, the refrigerant amount estimation unit 45 calculates the refrigerant shortage rate of the refrigerant circuit 6 (Step S17), and terminates the processing operation illustrated in FIG. 13.

Furthermore, if the detected value of the second feature value of each of the pairs P1 to P4 is abnormal (Step S15: Yes), the determination unit 46D in the abnormality estimation unit 46 determines that the refrigerant circuit 6 is abnormal, and determines whether the detected values of the second feature values of all of the pairs P1 to P4 are abnormal (Step S18). If the detected values of the second feature values of all of the pairs P1 to P4 are abnormal (Step S18: Yes), the determination unit 46D determines that the abnormality of the refrigerant circuit 6 is caused by abnormality of the outdoor unit 2 (Step S19). Then, the abnormality estimation unit 46 performs an abnormality output process (Step S20), and terminates the processing operation illustrated in FIG. 13. As a result, the abnormality estimation unit 46 is able to identify that the abnormality of the refrigerant circuit 6 is caused by abnormality of the outdoor unit 2.

If not all of the detected values of the second feature values of all of the pairs P1 to P4 are abnormal (Step S18: No), the determination unit 46D determines that the detected value of the second feature value of only a certain pair is abnormal (Step S21). Meanwhile, when the determination unit 46D determines that the detected value of the second feature value of only a certain pair is abnormal, it is possible to also identify a pair in which the abnormality has occurred as described above. Furthermore, if it is determined that the detected value of the second feature value of only a certain pair is abnormal, the determination unit 46D determines that the abnormality of the refrigerant circuit 6 is caused by abnormality of the indoor unit 3 of the certain pair that is determined as abnormal (Step S22), and returns to Step S20 to perform the abnormality output process. As a result, the abnormality estimation unit 46 is able to identify the indoor unit 3 that causes the abnormality of the refrigerant circuit 6 among the plurality of indoor units 3.

In the data filtering process, not all of the operating state quantities are used, but only a part of the operating state quantities (the detected value of the first feature value and the detected value of the second feature value) that is needed for the abnormality estimation process or that is needed to calculate the refrigerant shortage rate from among the plurality of operating state quantities is extracted based on a predetermined filter condition. By assigning the first feature value and the detected value of the second feature value (an abnormal value and an outlier are eliminated) that are subjected to the data filtering process (to be described later) to the generated refrigerant amount estimation model 45A and the generated abnormality estimation model 46A, it is possible to more accurately estimate abnormality by using the second feature value and more accurately estimate the refrigerant shortage rate by using the first feature value.

The predetermined filter condition includes a first filter condition, a second filter condition, and a third filter condition. The first filter condition is a filter condition for data that is extracted commonly among all of operating modes of the air conditioner 1, for example. The second filter condition is a filter condition for data that is extracted at the time of cooling operation. The third filter condition is a filter condition for data that is extracted at the time of heating operation.

The first filter condition is, for example, a driving state of the compressor 11, identification of an operating mode, elimination of special operation, elimination of a missing value with respect to an acquired value, selection of a small value of a change amount of an operating state quantity that largely affects generation of each of the regression equations, or the like. The driving state of the compressor 11 is a condition needs to be determined because it is impossible to estimate the refrigerant shortage rate unless the compressor stably operates and the refrigerant circulates in the refrigerant circuit 6, and is the filter condition that is provided to eliminate an operating state quantity that is detected during a transition period, such as at the time of activation of the compressor 11.

The identification of the operating mode is a filter condition for extracting only an operating state quantity that is acquired at the time of cooling operation and at the time of heating operation. Therefore, an operating state quantity that is acquired during dehumidification operation or air supply operation is eliminated. The elimination of the special operation is a filter condition for eliminating an operating state quantity that is acquired during special operation, such as oil recovery operation or defrosting operation, in which the state of the refrigerant circuit 6 largely differs from the state at the time of cooling operation and at the time of heating operation. The elimination of the missing value is a filter condition for eliminating an operating state quantity that includes a missing value because when the operating state quantity that is used for determination of the refrigerant shortage rate includes a missing value, and if the operating state quantity is used to generate each of the regression equations, accuracy of each of the regression equations may be reduced.

The selection of the small value of the change amount of the operating state quantity that is assigned to each of the regression equations or each of the refrigerant shortage rate calculation formulas is a filter condition for extracting only an operating state quantity in a case where the operating state of the air conditioner 1 is stable, and is a condition that is needed to improve estimation accuracy using each of the regression equations and each of the refrigerant shortage rate calculation formulas. Meanwhile, the operating state quantity that has large influence is, for example, the degree of supercooling of the refrigerant that is used when the refrigerant shortage rate is 0% to 30% at the time of cooling operation, the suction temperature that is used when the refrigerant shortage rate is 40% to 70% at the time of cooling operation, the degree of suction superheat at the time of heating operation, or the like.

The second filter condition includes, for example, elimination of the heat exchange outlet temperature, abnormality of the subcool, abnormality of the discharge temperature, or the like.

The elimination of the heat exchange outlet temperature is a filter condition that takes into account the fact that, because the outdoor air temperature sensor 36 and the refrigerant temperature sensor 35 are located close to each other, the heat exchange outlet temperature detected by the refrigerant temperature sensor 35 at the time of cooling operation does not become lower than the outdoor air temperature detected by the outdoor air temperature sensor 36, and is a filter condition for eliminating the heat exchange outlet temperature that is lower than the outdoor air temperature.

The abnormality of the subcool is a filter condition for eliminating a degree of supercooling of the refrigerant that is abnormally high or abnormally low because a cooling load is extremely large or small when the degree of supercooling of the refrigerant as described above is detected. The abnormality of the discharge temperature is a filter condition for eliminating discharge temperature that is detected when what is called an out-of-gas state is detected in which the amount of refrigerant that is sucked into the compressor 11 is reduced due to a small cooling load.

The third filter condition is, for example, abnormality of the discharge temperature or the like. When the discharge temperature increases due to a large heating load at the time of heating operation and discharge temperature protection control is performed, the rotation speed of the compressor 11 is reduced to reduce the discharge temperature, and, the third filter condition is a filter condition for eliminating the discharge temperature that is detected at this time.

The data cleansing process is a process for eliminating the detected value of the first feature value that may lead to erroneous estimation, instead of using all of the acquired detected values of the first feature values for estimation of the refrigerant shortage rate. Further, the data cleansing process is also a process for eliminating the detected value of the second feature value that may lead to erroneous abnormality estimation, instead of using all of the acquired detected values of the second feature values for the abnormality estimation process. Specifically, the acquired operating state quantities may be smoothed to perform noise control, data amount limitation, or the like. The noise control based on the data smoothing is a process of preventing noise by calculating averages in a subject interval and calculating a moving average of the degree of supercooling of the refrigerant, the suction temperature, and the degree of suction superheat in each of the models, for example. The data amount limitation is a process for eliminating data whose amount is small because reliability of such data is low, for example. For example, if the number of pieces of data that remain after the filtering process is performed on pieces of input data corresponding to one day is equal to or larger than X, the data is used for estimation of the refrigerant shortage rate or the abnormality estimation process on the second feature value, and if the number of pieces of data is smaller than X, all pieces of the data corresponding to the day are not used. In other words, in the data cleansing process, it is possible to more accurately estimate the refrigerant shortage rate by assigning the operating state quantities, from which the abnormal value and the outlier are eliminated, to the refrigerant amount estimation model 45A, and it is possible to more accurately estimate abnormality by assigning the operating state quantities, from which the abnormal value and the outlier are eliminated, to the abnormality estimation model 46A.

The abnormality estimation process is a process of calculating the degree of deviation (outlier) form a local maximum value (center of a cluster) of the density function based on the density function of an entire distribution that is estimated from simulation values of the second feature values, and determining whether the outlier falls within a predetermined range (whether determination target data is included in the cluster). The second feature value of each of the pairs P1 to P4 acquired from the operating air conditioner 1 is applied to the abnormality estimation model 46A and an outlier is calculated. In the abnormality estimation process, the value of the second feature value that is used to generate the abnormality estimation model 46A is adopted as a normal sample value, and an outlier from the normal sample value of the detected value of the second feature value of each of the pairs P1 to P4 that is acquired by the acquisition unit 41 at a different timing is calculated. Further, in the abnormality estimation process, if the absolute value of the calculated outlier is equal to or larger than the absolute value of the outlier threshold X, the detected value of the second feature value in the subject pair is classified as abnormal. Furthermore, in the abnormality estimation process, if the absolute value of the calculated outlier is smaller than the absolute value of the outlier threshold X, the detected value of the second feature value of the subject pair is classified as normal.

The determination unit 46D is able to identify the indoor unit 3 or the outdoor unit 2 as a cause of the abnormality of the refrigerant circuit 6 based on the classification result of each of the pairs P1 to P4. If the detected values of the second feature values of all of the pairs P1 to P4 are abnormal, the determination unit 46D identifies abnormality of the outdoor unit 2 as the cause of the abnormality of the refrigerant circuit 6 Further, if the detected value of the second feature value of a certain pair is abnormal, the determination unit 46D identifies abnormality of the indoor unit 3 of the certain pair that is classified as abnormal as the cause of the abnormality of the refrigerant circuit 6.

Figure 14:
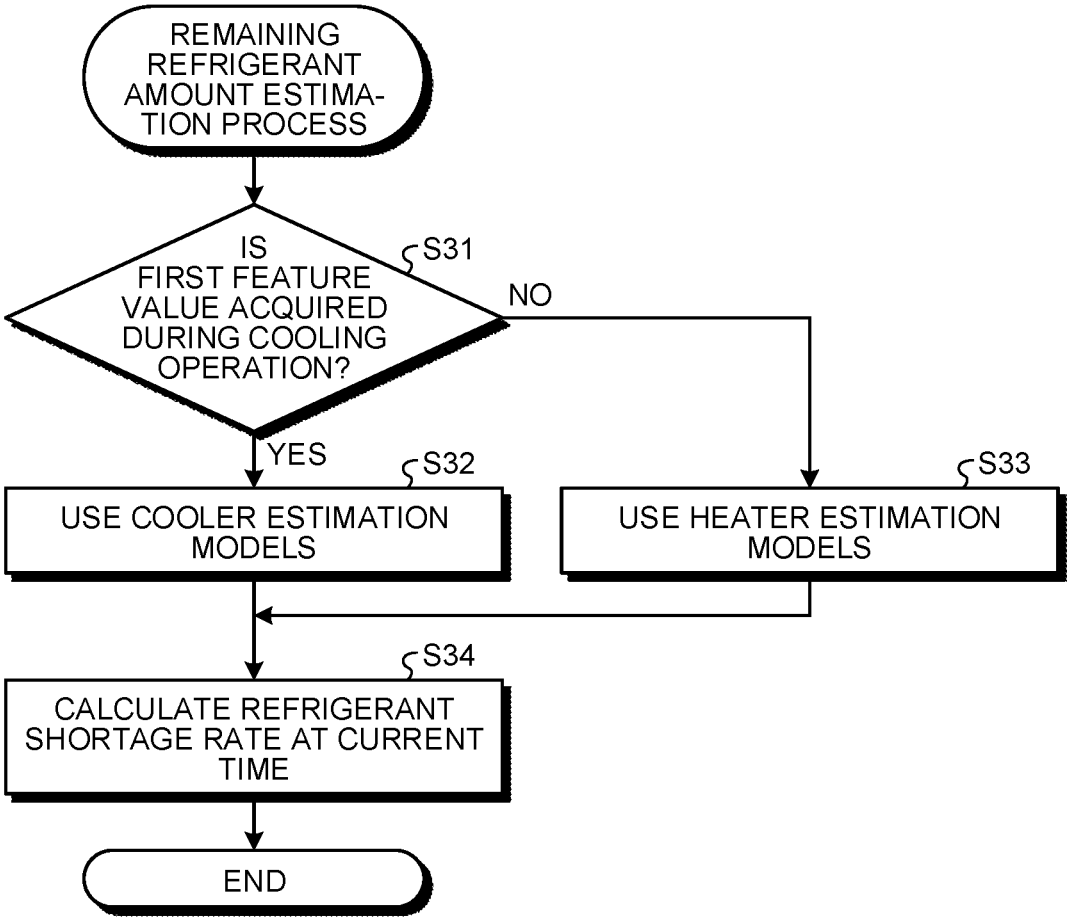
FIG. 14 is a flowchart illustrating an example of processing operation performed by the control circuit related to a remaining refrigerant amount estimation process.

FIG. 14 is a flowchart illustrating an example of the processing operation performed by the control circuit 19 in relation to the remaining refrigerant amount estimation process. The estimation of the remaining refrigerant amount is a process of calculating the refrigerant shortage rate of the refrigerant circuit 6 at a current time by, for example, assigning the detected value of the first feature value, which is acquired at the same time as the detected value of the second feature value that is classified as normal in the abnormality estimation process among the current operating state quantities (sensor values) that are subjected to the data filtering process and the data cleansing process, to each of the regression equations or each of the refrigerant shortage rate calculation formulas of the refrigerant amount estimation model 45A. In FIG. 14, the refrigerant amount estimation unit 45 in the control circuit 19 determines whether the acquired first feature value is acquired during cooling operation (Step S31). If the acquired first feature value is acquired during cooling operation (Step S31: Yes), the refrigerant amount estimation unit 45 applies the first feature value to each of the first cooler estimation model 45A1 to the third cooler estimation model 45A3 (Step S32).

If the acquired first feature value is not acquired during cooling operation (Step S31: No), that is, if the acquired first feature value is acquired during heating operation, the refrigerant amount estimation unit 45 applies the first feature value to each of the first heater estimation model 45A4 to the third heater estimation model 45A6 (Step S33). Further, the refrigerant amount estimation unit 45 calculates the refrigerant shortage rate at the current time by combining results obtained by applying the first feature value to each of the first cooler estimation model 45A1 to the third cooler estimation model 45A3 and results obtained by applying the first feature value to each of the first heater estimation model 45A4 to the third heater estimation model 45A6 (Step S34), and terminates the processing operation illustrated in FIG. 14.

In the abnormality output process, the detected value of the second feature value that is classified as abnormal in the abnormality estimation process is stored, as an abnormality log, in the abnormality log storage unit 43A and an alarm is output. As a result, it is possible to store the abnormal detected value of the second feature value.

Effect of First Embodiment

In the air conditioner 1 of the first embodiment, the value of the second feature value that is used to generate the abnormality estimation model 46A is adopted as a normal sample value, and an outlier from the normal sample value of the detected value of the second feature value of each of the pairs P1 to P4 that is detected at a different timing is calculated. Further, in the air conditioner 1, if the absolute value of the calculated outlier is equal to or larger than the absolute value of the outlier threshold X, the detected value of the second feature value of the subject pair is classified as abnormal, and it is estimated that the refrigerant circuit 6 is abnormal. Furthermore, in the air conditioner 1, the detected value of the first feature value that is acquired at the same time as the detected value of the second feature value of the pair that is classified as abnormal is not used for the refrigerant amount estimation model 45A. As a result, it is possible to accurately estimate the refrigerant shortage rate of the refrigerant circuit 6.

The air conditioner 1 is able to identify the indoor unit 3 or the outdoor unit 2 as a cause of the abnormality of the refrigerant circuit 6 based on the classification result of each of the pairs P1 to P4. If the detected values of the second feature values of all of the pairs P1 to P4 are abnormal, the air conditioner 1 identifies abnormality of the outdoor unit 2 as the cause of the abnormality of the refrigerant circuit 6. Further, if the detected value of the second feature value of a certain pair is abnormal, the air conditioner 1 identifies abnormality of the indoor unit 3 of the certain pair that is classified as abnormal as the cause of the abnormality of the refrigerant circuit 6. As a result, even if it is estimated that abnormality other than a change of the remaining refrigerant amount has occurred, it is possible to estimate the outdoor unit 2 or the indoor unit 3 in which the abnormality has occurred.

For example, when the refrigerant shortage rate is to be estimated by the refrigerant amount estimation model 45A that is generated by a linear analysis of the multiple regression analysis, and if the first feature value has changed due to leakage of the refrigerant and a failure other than the leakage of the refrigerant, the refrigerant shortage rate may be estimated as a small value even if the refrigerant shortage rate is increased (=abnormal) depending on a degree of change of each of the feature values. For example, if the rotation speed of the compressor and the suction temperature are changed due to a failure other than the leakage of the refrigerant, and the amounts of changes of the respective values are cancelled out, the refrigerant shortage rate may be estimated as a small value (=a normal amount). However, in the air conditioner 1 of the present embodiment, the detected value of the first feature value, which is acquired at the same time as the detected value of the second feature value that is classified as abnormal by the abnormality estimation model 46A that is generated by a non-linear analysis, such as the Kernel density estimation method, is not used. As a result, it is possible to prevent erroneous estimation of the refrigerant shortage rate.

Furthermore, originally, if the refrigerant amount estimation model 45A that is generated by the linear analysis is used, it may be possible to estimate that the refrigerant shortage rate has increased (=abnormal) even though the refrigerant shortage rate has a small value (=normal). For example, there may be a case in which the refrigerant shortage rate may be estimated as having been increased as a result of a change of the rotation speed of the compressor due to a failure other than the leakage of the refrigerant. However, in the air conditioner 1 of the first embodiment, the detected value of the first feature value that is acquired at the same time as the detected value of the second feature value that is classified as abnormal by the abnormality estimation model 46A that is generated by the non-linear analysis is not used for the refrigerant amount estimation model 45A. As a result, it is possible to prevent erroneous estimation of the refrigerant shortage rate.

If the absolute value of the calculated outlier is smaller than the absolute value of the outlier threshold X, the abnormality estimation model 46A of the air conditioner 1 classifies the detected value of the second feature value of the subject pair as normal. Further, the air conditioner 1 performs the multiple regression analysis on the detected value of the first feature value that is acquired at the same time as the detected value of the second feature value of the pair that is classified as normal, and calculates the refrigerant shortage rate of the refrigerant circuit 6. As a result, it is possible to accurately estimate the refrigerant shortage rate of the refrigerant circuit 6.

The abnormality estimation model 46A that is mounted on the air conditioner 1 is generated by a non-linear analysis, such as the Kernel density estimation method, by using a part of the detected value of the first feature value used for the refrigerant amount estimation model 45A and by using the value of the second feature value that includes an operating state quantity that largely affects cooling cycle operation. The abnormality estimation model 46A classifies the detected value of the second feature value of each of the pairs P1 to P4 as normal or abnormal. Further, in the refrigerant amount estimation model 45A, the refrigerant amount estimation model 45A is generated by using the detected value of the first feature value that is acquired at the same time as the detected value of the second feature value that is classified as normal, instead of using all of the operating state quantities. As a result, it is possible to generate the refrigerant amount estimation model 45A with high accuracy.

In the present embodiment, each of the regression equations of the refrigerant amount estimation model 45A is generated by using the detected value of the first feature value that is obtained by a simulation, and the detected value of the first feature value that is obtained by the simulation does not include an abnormal value and a certain value that is extremely large or small as compared to other values. In this manner, the detected value of the operating state quantity that is subjected to the data filtering process and the data cleansing process to eliminate an abnormal value and an outlier is assigned to each of the regression equations or each of the refrigerant shortage rate calculation formulas of the refrigerant amount estimation model 45A that is generated using the feature value that is obtained by a simulation. In this case, by assigning only the detected value of the first feature value that is acquired at the same time as the detected value of the second feature value that is classified as normal by using the abnormality estimation model 46A, it is possible to more accurately estimate the refrigerant shortage rate.

The abnormality estimation model 46A is generated by using the feature value that is obtained by a simulation, and the feature value that is obtained by the simulation does not include an abnormal value and a certain value that is extremely larger or smaller than other values. By applying the detected value of the second feature value from which the abnormal value and the outlier are eliminated by performing the data filtering process and the data cleansing process as described above to the abnormality estimation model 46A that is generated by using the feature value that does not include the abnormal value and the outlier, it is possible to more accurately determine the detected value of the second feature value. Further, by performing the data filtering process and the data cleansing process, the control circuit 19 is able to reduce the amount of data used to calculate the outlier by the abnormality estimation model 46A, so that it is possible to reduce a time needed for the calculation of the outlier by the abnormality estimation model 46A and reduce a load on the control circuit 19.

Meanwhile, in the first embodiment as described above, the example has been described in which the simulation result of each of the operating state quantities is obtained at the design stage of the air conditioner 1, and the control circuit 19 stores the refrigerant amount estimation model 45A and the abnormality estimation model 46A that are obtained by causing an information processing apparatus, such as a server, with a learning function to learn a simulation result. Alternatively, it may be possible to provide a server 120 that is connected to the air conditioner 1 by a communication network 110, and cause the server 120 to generate the refrigerant amount estimation model 45A and the abnormality estimation model 46A and transmit an estimation result of the refrigerant amount estimation model 45A and an estimation result of the abnormality estimation model 46A to the air conditioner 1. This embodiment will be described below.

Second Embodiment

Configuration of Air Conditioning System

Figure 15:
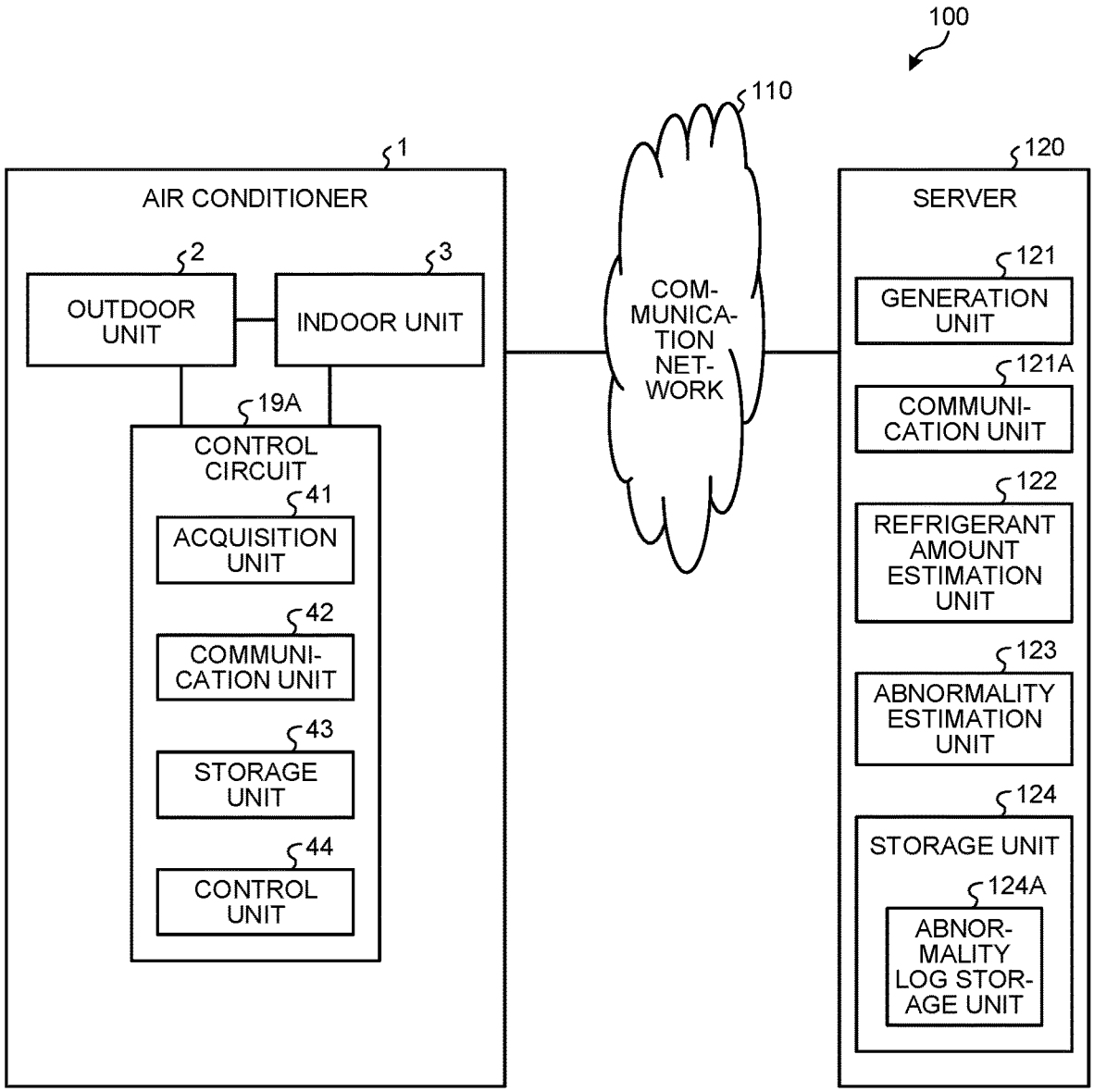
FIG. 15 is an explanatory diagram illustrating an example of an air conditioning system of a second embodiment.

FIG. 15 is an explanatory diagram illustrating an example of an air conditioning system 100 of a second embodiment. Meanwhile, the same components as those of the air conditioner 1 of the first embodiment are denoted by the same reference symbols, and explanation of the same components and operation will be omitted. The air conditioning system 100 illustrated in FIG. 15 includes the air conditioner 1, the communication network 110, and the server 120. The air conditioner 1 includes the compressor 11, the outdoor unit 2 that includes the outdoor heat exchanger 13 and the outdoor unit expansion valve 14, the indoor unit 3 that includes the indoor heat exchanger 51, and a control circuit 19A. The air conditioner 1 includes the refrigerant circuit 6 that is configured by connecting the outdoor unit 2 and the indoor unit 3 by refrigerant pipes, such as the liquid pipe 4 and the gas pipe 5, and a predetermined amount of refrigerant is stored in the refrigerant circuit 6. The control circuit 19A includes the acquisition unit 41, the communication unit 42, the storage unit 43, and the control unit 44. Meanwhile, the control circuit 19A does not include the refrigerant amount estimation unit 45, the abnormality estimation unit 46, and the abnormality log storage unit 43A.

The server 120 includes a generation unit 121, a communication unit 121A, a refrigerant amount estimation unit 122, an abnormality estimation unit 123, and a storage unit 124. The storage unit 124 includes an abnormality log storage unit 124A. The generation unit 121 generates the refrigerant amount estimation model 45A by a multiple regression analysis method by using a detected value or a simulation value of the first feature value related to estimation of the refrigerant shortage rate of the refrigerant that is stored in the refrigerant circuit 6. Meanwhile, the refrigerant amount estimation model 45A includes, for example, the first cooler estimation model 45A1, the second cooler estimation model 45A2, the third cooler estimation model 45A3, the first heater estimation model 45A4, the second heater estimation model 45A5, and the third heater estimation model 45A6 that are explained in the first embodiment. The refrigerant amount estimation unit 122 stores therein the refrigerant amount estimation model 45A that is generated by the generation unit 121. Further, the generation unit 121 generates the abnormality estimation model 46A by the Kernel density estimation method by using the detected values of the second feature values of all of the pairs P1 to P4 that are obtained by a simulation in the steady state and the refrigerant leaked state. Meanwhile, the abnormality estimation model 46A includes, for example, the cooling-period abnormality estimation model 46B and the heating-period abnormality estimation model 46C described in the first embodiment.

The abnormality estimation unit 123 stores therein the abnormality estimation model 46A that is generated by the generation unit 121. The abnormality estimation unit 123 classifies the detected value of the second feature value as normal or abnormal by using the abnormality estimation model 46A. If the detected value of the second feature value is classified as abnormal, the abnormality estimation unit 123 stores the detected value of the second feature value that is classified as abnormal, as an abnormality log, in the abnormality log storage unit 124A. Further, the determination unit 46D in the abnormality estimation unit 123 identifies the indoor unit 3 or the outdoor unit 2 that is a cause of the abnormality of the refrigerant circuit 6 based on a classification result obtained by the abnormality estimation unit 123, that is, a classification result of each of the pairs P1 to P4. The communication unit 121A transmits a result of identification of the indoor unit 3 or the outdoor unit 2 as the cause of the abnormality of the refrigerant circuit 6, which is obtained by the determination unit 46D, to the air conditioner 1 via the communication network 110. The control circuit 19A of the air conditioner 1 is able to identify the cause of the abnormality of the refrigerant circuit 6 based on the result of identification of the indoor unit 3 or the outdoor unit 2 as the cause of the abnormality of the refrigerant circuit 6, which is received from the server 120.

Furthermore, the refrigerant amount estimation unit 122 calculates the refrigerant shortage rate in the refrigerant circuit 6 of the air conditioner 1 by using the detected value of the first feature value that is acquired at the same time as the detected value of the second feature value that is classified as normal by the abnormality estimation model 46A and by using the received refrigerant amount estimation model 45A. The communication unit 121A transmits the refrigerant shortage rate that is calculated by the refrigerant amount estimation unit 122 to the air conditioner 1 via the communication network 110. The control circuit 19A of the air conditioner 1 is able to identify the refrigerant shortage rate of the refrigerant circuit 6 based on the refrigerant shortage rate that is received from the server 120.

The generation unit 121 generates or updates the cooling-period abnormality estimation model 46B by using the values of the second feature values of all of the pairs P1 to P4 that are obtained by a simulation in the steady state and the refrigerant leaked state at the time of cooling while the refrigerant circuit 6 is in the normal state.

The generation unit 121 periodically collects the operating state quantities at the time of cooling operation from a standard machine (installed in a test room or the like of a manufacturing company) of the air conditioner 1 that is able to measure the steady state and the refrigerant leaked state at the time of cooling while the refrigerant circuit 6 is in the normal state, and generates or updates the cooling-period abnormality estimation model 46B by using a comparison result between a classification result indicating normal or abnormal obtained by the cooling-period abnormality estimation model 46B and an actually measured classification result and by using the collected operating state quantities. As a result, it is possible to generate the cooling-period abnormality estimation model 46B with high accuracy.

The generation unit 121 periodically collects the operating state quantities at the time of cooling operation from the standard machine (installed in the test room or the like of the manufacturing company) of the air conditioner 1 that is able to measure the refrigerant shortage rate of the refrigerant circuit 6, and generates or updates the first cooler estimation model 45A1, the second cooler estimation model 45A2, and the third cooler estimation model 45A3 by using a comparison result between the refrigerant shortage rate that is estimated by each of the refrigerant amount estimation models 45A and the actually measured refrigerant shortage rate and by using the collected operating state quantities. Meanwhile, as in the first embodiment, it may be possible to obtain, by a simulation, the operating state quantity that is used to generate each of the refrigerant amount estimation models 45A, and the generation unit 121 may generate each of the refrigerant amount estimation models 45A by using each of the operating state quantities that are obtained by the simulation.

The generation unit 121 generates or updates the heating-period abnormality estimation model 46C by using the values of the second feature values of all of the pairs P1 to P4 that are obtained by a simulation in the steady state and the refrigerant leaked state at the time of heating while the refrigerant circuit 6 is in the normal state.

The generation unit 121 periodically collects the operating state quantities at the time of heating operation from the standard machine (installed in the test room or the like of the manufacturing company) of the air conditioner 1 that is able to measure the steady state and the refrigerant leaked state at the time of heating while the refrigerant circuit 6 is in the normal state, and generates or updates the heating-period abnormality estimation model 46C by using a comparison result between the classification result indicating normal or abnormal obtained by the heating-period abnormality estimation model 46C and the actually measured classification result and by using the collected operating state quantities. As a result, it is possible to generate the heating-period abnormality estimation model 46C with high accuracy.

The generation unit 121 periodically collects the operating state quantities at the time of heating operation from the standard machine of the air conditioner 1 as described above, and generates the first heater estimation model 45A4, the second heater estimation model 45A5, and the third heater estimation model 45A6 by using a comparison result between the refrigerant shortage rate that is estimated by each of the refrigerant amount estimation models 45A and by using the collected operating state quantities. Meanwhile, as in the first embodiment, it may be possible to obtain, by a simulation, the operating state quantity that is used to generate each of the refrigerant amount estimation models 45A, and the generation unit 121 may generate each of the refrigerant amount estimation models 45A by using the operating state quantity that is obtained by the simulation.

The generation unit 121 generates the abnormality estimation model 46A by using the feature value that is obtained by the simulation, and the value of the feature value that is obtained by the simulation does not include an abnormal value and an extremely large or small value as compared to other values. By applying the detected value of the second feature value from which the abnormal value and the outlier are eliminated by performing the data filtering process and the data cleansing process as described above to the abnormality estimation model 46A that is generated by using the feature value that does not include the abnormal value and the outlier, it is possible to more accurately determine the detected value of the second feature value. Further, if the generation unit 121 performing the data filtering process and the data cleansing process on the second feature value as described in the first embodiment, it is possible to reduce the amount of data used to calculate the outlier by the abnormality estimation model 46A. As a result, it is possible to reduce a time needed for the calculation of the outlier by the abnormality estimation model 46A and reduce a usage rate of the server 120; therefore, if the server 120 adopts a metered system in which costs increases with an increase in use, it is possible to reduce cost needed for the calculation of the outlier.

Effects of Second Embodiment

The server 120 of the second embodiment generates the abnormality estimation model 46A by using the values of the second feature values of all of the pairs P1 to P4 that are obtained by a simulation in the steady state and the refrigerant leaked state while the refrigerant circuit 6 is in the normal state, and stores the generated abnormality estimation model 46A in the abnormality estimation unit 123. The abnormality estimation unit 123 in the server 120 is able to classify whether the detected value of the second feature value of each of the pairs P1 to P4 obtained at a different timing is normal or abnormal by using the stored abnormality estimation model 46A. Further, the air conditioner 1 estimates whether the refrigerant circuit 6 of each of the pairs P1 to P6 is abnormal or normal based on the classification result of the detected value of the second feature value of each of the pairs. The abnormality estimation unit 123 identifies the outdoor unit 2 or the indoor unit 3 as the cause of the abnormality of the refrigerant circuit 6 based on the estimation result indicating occurrence of abnormality of the refrigerant circuit 6 of each of the pairs. The communication unit 121A transmits an identification result indicating the outdoor unit 2 or the indoor unit 3 as the cause of the abnormality of the refrigerant circuit 6 to the air conditioner 1. As a result, the air conditioner 1 is able to identify the outdoor unit 2 or the indoor unit 3 as the cause of the abnormality of the refrigerant circuit 6.

The server 120 generates the refrigerant amount estimation model 45A by using the value of the first feature value that is acquired from the air conditioner 1, and stores the generated refrigerant amount estimation model 45A in the refrigerant amount estimation unit 122. The server 120 estimates the refrigerant shortage rate by using the stored refrigerant amount estimation model 45A, and transmits the estimation result to the air conditioner 1 via the communication network 110. As a result, the air conditioner 1 is able to recognize the refrigerant shortage rate of the refrigerant circuit 6.

Meanwhile, in the air conditioner 1 of the first embodiment and the second embodiment, the examples are described in which the four indoor units 3 are connected to the single outdoor unit 2, but the number of the indoor units 3 is not limited to four as long as the plurality of indoor units 3 are provided, and the number may be changed appropriately.

Further, in the present embodiment, the case has been described in which a relative refrigerant amount is estimated as an amount that represents the amount of refrigerant that remains in the refrigerant circuit 6. Specifically, the case has been described in which the refrigerant shortage rate that is a ratio of an amount of refrigerant that has leaked to the outside from the refrigerant circuit 6 to the storage amount (initial amount) of the refrigerant that is stored in the refrigerant circuit 6 is estimated and provided. However, the present invention is not limited to this example, and it may be possible to multiply the estimated refrigerant shortage rate by the initial value, and provide the amount of the refrigerant that has leaked to the outside from the refrigerant circuit 6. Furthermore, it may be possible to generate an estimation model for estimating an absolute amount of the refrigerant that has leaked to the outside from the refrigerant circuit 6 or an absolute amount of the refrigerant that remains in the refrigerant circuit 6, and provide an estimation result that is obtained by the estimation model. When the estimation model for estimating the absolute amount of the refrigerant that has leaked to the outside from the refrigerant circuit 6 or the absolute amount of the refrigerant that remains in the refrigerant circuit 6 is to be generated, it is sufficient to take into account volumes of the outdoor heat exchanger 13 and each of the indoor heat exchangers 51 and a volume of the liquid pipe 4 as described above, in addition to each of the operating state quantities as described above.

Modification

Meanwhile, in the present embodiment, for example, the case has been described in which the estimation result obtained by the first cooler estimation model 45A1 and the estimation result obtained by the second cooler estimation model 45A2 are interpolated by the sigmoid coefficient, but embodiments are not limited to the sigmoid coefficient; for example, an interpolation method, such as linear interpolation, may be used, and an appropriate change may be made.

In the present embodiment, a part of simulation results among a plurality of simulation results are used, rather than using all of the simulation results. For example, the first cooler estimation model 45A1 that is used when the refrigerant shortage rate is 0% to 30% at the time of cooling operation, the second cooler estimation model 45A2 that is used when the refrigerant shortage rate is 40% to 70%, and the third cooler estimation model 45A3 that is used when the refrigerant shortage rate is 30% to 40% are generated separately. Therefore, the operating state quantities are prepared by simulations, so that when the operating quantities are collected by operating the air conditioner 1, it is possible to easily collect a needed amount of operating state quantities by comparison.

In the present embodiment, the case has been described in which the refrigerant amount estimation model 45A and the abnormality estimation model 46A are generated by the server 120 or the control circuit 19, but a user may calculate the refrigerant amount estimation model 45A and the abnormality estimation model 46A from the simulation result. Further, in the present embodiment, the case has been described in which each of the estimation models is generated by using the multiple regression analysis method, but it may be possible to generate an estimation model by using support vector regression (SVR), a neural network (NN), or the like of a machine learning model that can perform a general regression analysis method. In this case, to select a feature value, it is sufficient to use a general method (a forward feature selection method, a backward feature elimination, or the like) for selecting a feature value such that accuracy of the estimation model is improved, instead of the P value and the correction value R2 that are used in the multiple regression analysis method.

The case has been described in which the abnormality estimation model 46A is generated by using the values of the second feature values of all of the pairs that are obtained by a simulation in the steady state and the refrigerant leaked state while the refrigerant circuit 6 is in the normal state, and the outlier is calculated by adopting, as normal sample values, the values of the second feature values of all of the pairs and quantifying a distance between the detected value of the second feature value and the normal sample value in each of the pairs. However, the abnormality estimation model 46A may be generated by using the value of the second feature value of each of the pairs that is obtained by a simulation in the steady state and the refrigerant leaked state while the refrigerant circuit 6 is in the normal state, and calculate the outlier by adopting, as the normal sample value, the value of the second feature value of each of the pairs used for the generation and quantifying a distance from the detected value of the second feature value and the normal sample value in the same pair, where an appropriate change may be made.

Furthermore, the case has been described in which the abnormality estimation model 46A is generated by using the value of the second feature value that is obtained by a simulation in the steady state and the refrigerant leaked state while the refrigerant circuit 6 is in a normal state, but it may be possible to generate the model by using only the value of the second feature value that is obtained by a simulation in the steady state while the refrigerant circuit 6 is in the normal state, without using the value of the second feature value in the refrigerant leaked state.

Moreover, in the present embodiment, the case has been described in which the abnormality estimation model 46A is generated by using the Kernel density estimation method, but embodiments are not limited to the Kernel density estimation method as long as the method is a non-linear analytic method, and an appropriate change may be made.

Furthermore, in the present embodiment, the example has been described in which the one or more indoor units 3 are connected to the single outdoor unit 2 in the air conditioner 1, but the technology is applicable to the air conditioner 1 in which the one or more indoor units 3 are connected to the two or more outdoor units 2.

In the first embodiment, the case has been described in which the simulation result of each of the operating state quantities is obtained at the design stage of the air conditioner 1, and the control circuit 19 stores therein the refrigerant amount estimation model 45A and the abnormality estimation model 46A that are generated by causing an information processing apparatus, such as a server, with a learning function to learn a simulation result. However, it may be possible to provide a server that is connected to the air conditioner 1 via the communication network, and the server may generate and transmit the refrigerant amount estimation model 45A and the abnormality estimation model 46A to the air conditioner 1. Further, the air conditioner 1 may store the refrigerant amount estimation model 45A and the abnormality estimation model 46A that are received from the server in the control circuit 19.

The refrigerant circuit 6 is configured such that at least the one indoor unit 3, which is connected to at least the one outdoor unit 2, is connected by a refrigerant pipe. Therefore, the refrigerant amount estimation model 45A is able to estimate the refrigerant shortage rate by using the detected value of the first feature value of the single representative outdoor unit 2 among at least the one outdoor unit 2 and the detected value of the first feature value of the single representative indoor unit 3 among at least the one indoor unit 3. Meanwhile, it is assumed that the representative outdoor unit 2 is selected from at least the one operating outdoor unit 2 based on an arbitrary rule, and the representative indoor unit 3 is selected from at least the one operating indoor unit 3 based on an arbitrary rule. The arbitrary rule is, for example, ascending order of identification numbers that are assigned to respective devices.

Furthermore, the components illustrated in the drawings need not necessarily be physically configured in the manner illustrated in the drawings. In other words, specific forms of distribution and integration of the components are not limited to those illustrated in the drawings, and all or part of the components may be functionally or physically distributed or integrated in arbitrary units depending on various loads or use conditions.

Moreover, all or part of various processing functions implemented by each of the apparatuses may be implemented by a central processing unit (CPU) (or a microcomputer, such as a micro processing unit (MPU) or a micro controller unit (MCU)). Furthermore, all or part of each of the various processing functions may be realized by a CPU and a program analyzed and executed by the CPU, or may be realized by hardware using wired logic.

Moreover, in each of the embodiments as described above, the refrigerant shortage rate is assumed as an amount of reduction from a prescribed amount, where 100% indicates that the prescribed amount of the refrigerant is stored. Alternatively, it may be possible to estimate the refrigerant shortage rate by the method described in the embodiments immediately after the prescribed amount of the refrigerant is stored in the refrigerant circuit 6, and adopt the estimation result as 100%. For example, if the refrigerant shortage rate that is estimated immediately after the prescribed amount of refrigerant is stored in the refrigerant circuit 6 is 90%, that is, if it is estimated that the amount of refrigerant that is currently stored in the refrigerant circuit 6 is smaller than the prescribed amount by 10%, it may be possible to adopt a refrigerant amount that is smaller than the prescribed amount by 10% as 100%. By adjusting the refrigerant amount that is adopted as 100% in accordance with the refrigerant amount, it is possible to more accurately estimate the refrigerant shortage rate from next time.

REFERENCE SIGNS LIST

1 air conditioner
2 outdoor unit
3 indoor unit
41 acquisition unit
44 control unit
45 refrigerant amount estimation unit
45A refrigerant amount estimation model
46 abnormality estimation unit
46A abnormality estimation model
46B cooling-period abnormality estimation model
46C heating-period abnormality estimation model
46D determination unit
100 air conditioning system
120 server
121 generation unit
121A communication unit
122 refrigerant amount estimation unit
123 abnormality estimation unit

The invention claimed is:

1. An air conditioning system comprising:
an air conditioner that includes
a refrigerant circuit in which at least one or more indoor units are connected to an outdoor unit by refrigerant pipes; and
a server that is communicably connected to the air conditioner, wherein
the air conditioner includes:
an first memory; and first processing circuitry coupled to the first memory and configured to:
detect a state quantity related to control on the air conditioner;
acquire a detected value of the state quantity that is detected by the detecting; and
transmit the detected value acquired by the acquiring to the server, and
the server includes:
a second memory; and second processing circuitry coupled to the second memory and configured to:
receive the detected value from the air conditioner; and
estimate occurrence of abnormality of the refrigerant circuit by using a detected value of a feature value by assuming that the state quantity related to abnormality of the refrigerant circuit is adopted as the feature value, wherein
the estimating adopts the outdoor unit and each of the indoor units as a single pair, estimates occurrence of abnormality in the refrigerant circuit for each of the pairs, estimates that abnormality has occurred in the indoor unit of a subject pair when estimating that abnormality has occurred in any of the pairs, and estimates that abnormality has occurred in the outdoor unit when estimating that abnormality has occurred in all of the pairs.

2. The air conditioning system according to claim 1, wherein
a predetermined amount of refrigerant is stored in the refrigerant circuit, and
the estimating estimates that the refrigerant circuit is normal when only a remaining refrigerant amount is changed.

3. The air conditioning system according to claim 1, wherein
the second processing circuitry is further configured to estimate
a remaining refrigerant amount of the refrigerant circuit by using a detected value of a first feature value by assuming that the state quantity related to a refrigerant amount of the refrigerant circuit is adopted as the first feature value, and
the estimating estimates occurrence of abnormality of the refrigerant circuit by using a detected value of a second feature value by assuming that a state quantity that includes at least one state quantity that is included in the first feature value and at least one state quantity that is not included in the first feature value is adopted as the second feature value.

4. The air conditioning system according to claim 3, wherein
the first estimating includes
a refrigerant amount estimation model that is generated by using the first feature value, and
estimates the remaining refrigerant amount by applying the detected value of the first feature value to the refrigerant amount estimation model, and
the estimating includes
an abnormality estimation model that is generated by using the second feature value, and
estimates occurrence of abnormality of the refrigerant circuit by applying the detected value of the second feature value to the abnormality estimation model.

5. The air conditioning system according to claim 4, wherein
the abnormality estimation model adopts the second feature value that is used to generate the abnormality estimation model as a normal sample value and calculates an outlier that indicates a degree of deviation from the normal sample value with respect to the detected value of the second feature value that is acquired by the acquiring, and
the estimating the abnormality
estimates that abnormality has occurred in the refrigerant circuit when an absolute value of the outlier calculated by the abnormality estimation model is equal to or larger than a predetermined threshold, and
estimates that the refrigerant circuit is normal when the absolute value of the outlier calculated by the abnormality estimation model is smaller than the predetermined threshold.

6. The air conditioning system according to claim 5, wherein only when the estimating the abnormality estimates that the refrigerant circuit is normal, the estimating the refrigerant amount estimates the remaining refrigerant amount of the refrigerant circuit by using the detected value of the first feature value that is acquired at the same time as the detected value of the second feature value that is used when the refrigerant circuit is estimated as normal.

7. The air conditioning system according to claim 6, wherein the estimating the abnormality estimates occurrence of abnormality of the refrigerant circuit before the estimating the refrigerant amount estimates the remaining refrigerant amount.

8. The air conditioning system according to claim 4, wherein the second feature value is a state quantity that is obtained as a result of a simulation of operation of the refrigerant circuit when the refrigerant circuit operates normally and only the remaining refrigerant amount is changed.

9. The air conditioning system according to claim 4, wherein the refrigerant amount estimation model is generated by using a linear analysis, and the abnormality estimation model is generated by using a non-linear analysis.

10. The air conditioning system according to claim 3, wherein the second feature value is a state quantity that is obtained as a result of a simulation of operation of the refrigerant circuit when the refrigerant circuit operates normally and only the remaining refrigerant amount is changed.

11. An abnormality estimation method that is implemented by an air conditioning system that includes an air conditioner that includes a refrigerant circuit in which at least one or more indoor units are connected to an outdoor unit by refrigerant pipes; and a server that is connected to the air conditioner by communication, the abnormality estimation method comprising:

detecting, by first processing circuitry of the air conditioner, a state quantity related to control on the air conditioner;

acquiring, by the first processing circuitry of the air conditioner, a detected value of the detected state quantity;

transmitting, by the first processing circuitry of the air conditioner, the acquired detected value to the server;

receiving, by second processing circuitry of the server, the detected value from the air conditioner;

estimating, by the second processing circuitry, occurrence of abnormality of the refrigerant circuit for each of pairs by using a detected value of a feature value by assuming that the state quantity related to abnormality of the refrigerant circuit is adopted as the feature value and by adopting the outdoor unit and each of the indoor units as a single pair;

estimating, by the second processing circuitry, that abnormality has occurred in the refrigerant circuit of a subject pair when estimating that abnormality has occurred in any of the pair; and estimating, by the second processing circuitry, that abnormality has occurred in the outdoor unit when estimating that abnormality has occurred in all of the pairs.

12. The abnormality estimation method according to claim 11, wherein a predetermined amount of refrigerant is stored in the refrigerant circuit, and the estimating the abnormality includes estimating that the refrigerant circuit is normal when only a remaining refrigerant amount is changed.

13. The abnormality estimation method according to claim 11, further including:

estimating, by the second processing circuitry, a remaining refrigerant amount of the refrigerant circuit by using a detected value of a first feature value by assuming that the state quantity related to a refrigerant amount of the refrigerant circuit is adopted as the first feature value, wherein the estimating the abnormality includes estimating occurrence of abnormality of the refrigerant circuit by using a detected value of a second feature value by assuming that a state quantity that includes at least one state quantity that is included in the first feature value and at least one state quantity that is not included in the first feature value is adopted as the second feature value.

14. The abnormality estimation method according to claim 13, further including:

a refrigerant amount estimation model that is generated by using the first feature value; and an abnormality estimation model that is generated by using the second feature value, wherein the estimating the refrigerant amount includes estimates the remaining refrigerant amount by applying the detected value of the first feature value to the refrigerant amount estimation model, and the estimating the abnormality includes estimating occurrence of abnormality of the refrigerant circuit by applying the detected value of the second feature value to the abnormality estimation model.

15. The abnormality estimation method according to claim 14, wherein the abnormality estimation model adopts the second feature value that is used to generate the abnormality estimation model as a normal sample value and calculates an outlier that indicates a degree of deviation from the normal sample value with respect to the detected value of the second feature value that is acquired by the acquiring, and the estimating the abnormality includes estimating that abnormality has occurred in the refrigerant circuit when an absolute value of the outlier calculated by the abnormality estimation model is equal to or larger than a predetermined threshold, and estimating that the refrigerant circuit is normal when the absolute value of the outlier calculated by the abnormality estimation model is smaller than the predetermined threshold.

16. The abnormality estimation method according to claim 15, wherein the estimating the refrigerant amount includes estimating, only when the estimating the abnormality estimates that the refrigerant circuit is normal, the remaining refrigerant amount of the refrigerant circuit by using the detected value of the first feature value that is acquired at the same time as the detected value of the second feature value that is used when the refrigerant circuit is estimated as normal.

17. The abnormality estimation method according to claim 16, wherein the estimating the abnormality is performed before the estimating the refrigerant amount.

18. An air conditioner that includes a refrigerant circuit in which at least one or more indoor units are connected to an outdoor unit by refrigerant pipes, the air conditioner comprising:

an first memory; and first processing circuitry coupled to the first memory and configured to:

detect a state quantity related to control on the air conditioner;

acquire a detected value of the state quantity that is detected by the detecting; and estimate occurrence of abnormality of the refrigerant circuit by using a detected value of a feature value by assuming that the state quantity related to abnormality of the refrigerant circuit is adopted as the feature value, wherein the estimating the abnormality adopts the outdoor unit and each of the indoor units as a single pair, estimates occurrence of abnormality in the refrigerant circuit for each of the pairs, estimates that abnormality has occurred in the indoor unit of a subject pair when estimating that abnormality has occurred in any of the pairs, and estimates that abnormality has occurred in the outdoor unit when estimating that abnormality has occurred in all of the pairs.

19. The air conditioner according to claim 18, wherein a predetermined amount of refrigerant is stored in the refrigerant circuit, and the estimating the abnormality estimates that the refrigerant circuit is normal when only a remaining refrigerant amount is changed.

20. The air conditioner according to claim 18, the first processing circuitry is further configured to estimate a remaining refrigerant amount of the refrigerant circuit by using a detected value of a first feature value by assuming that the state quantity related to a refrigerant amount of the refrigerant circuit is adopted as the first feature value, wherein the estimating the abnormality estimates occurrence of abnormality of the refrigerant circuit by using a detected value of a second feature value by assuming that a state quantity that includes at least one state quantity that is included in the first feature value and at least one state quantity that is not included in the first feature value is adopted as the second feature value.

21. The air conditioner according to claim 20, wherein the estimating the refrigerant amount includes a refrigerant amount estimation model that is generated by using the first feature value, and estimates the remaining refrigerant amount by applying the detected value of the first feature value to the refrigerant amount estimation model, the estimating the abnormality includes an abnormality estimation model that is generated by using the second feature value, and estimates occurrence of abnormality of the refrigerant circuit by applying the detected value of the second feature value to the abnormality estimation model.

22. The air conditioner according to claim 21, wherein the abnormality estimation model adopts the second feature value that is used to generate the abnormality estimation model as a normal sample value and calculates an outlier that indicates a degree of deviation from the normal sample value with respect to the detected value of the second feature value that is acquired by the acquiring, and the estimating the abnormality estimates that abnormality has occurred in the refrigerant circuit when an absolute value of the outlier calculated by the abnormality estimation model is equal to or larger than a predetermined threshold, and estimates that the refrigerant circuit is normal when the absolute value of the outlier calculated by the abnormality estimation model is smaller than the predetermined threshold.

23. The air conditioner according to claim 22, wherein only when the estimating the abnormality estimates that the refrigerant circuit is normal, the estimating the refrigerant amount estimates the remaining refrigerant amount of the refrigerant circuit by using the detected value of the first feature value that is acquired at the same time as the detected value of the second feature value that is used when the refrigerant circuit is estimated as normal.

24. The air conditioner according to claim 23, wherein the estimating the abnormality estimates occurrence of abnormality of the refrigerant circuit before the estimating the refrigerant amount estimates the remaining refrigerant amount.

25. The air conditioner according to claim 21, wherein the refrigerant amount estimation model is generated by using a linear analysis, and the abnormality estimation model is generated by using a non-linear analysis.

26. The air conditioner according to claim 20, wherein the second feature value is a state quantity that is obtained as a result of a simulation of operation of the refrigerant circuit when the refrigerant circuit operates normally and only the remaining refrigerant amount is changed.

27. An abnormality estimation method that is implemented by an air conditioner that includes a refrigerant circuit in which at least one or more indoor units are connected to an outdoor unit by refrigerant pipes, the abnormality estimation method comprising:

detecting a state quantity related to control on the air conditioner;

acquiring a detected value of the detected state quantity;

estimating occurrence of abnormality of the refrigerant circuit by using a detected value of a first feature value by assuming that the state quantity related to a refrigerant amount of the refrigerant circuit is adopted as the first feature value;

adopting the outdoor unit and each of the indoor units as a single pair;

estimating occurrence of abnormality in the refrigerant circuit for each of the pairs;

estimating that abnormality has occurred in the refrigerant circuit of a subject pair when estimating that abnormality has occurred in any of the pairs; and estimating that abnormality has occurred in the outdoor unit when estimating that abnormality has occurred in all of the pairs.

28. The abnormality estimation method according to claim 27, wherein a predetermined amount of refrigerant is stored in the refrigerant circuit, and the estimating the abnormality includes estimating that the refrigerant circuit is normal when only a remaining refrigerant amount is changed.

29. The abnormality estimation method according to claim 27, further including:

estimating a remaining refrigerant amount of the refrigerant circuit by using a detected value of a first feature value by assuming that the state quantity related to a refrigerant amount of the refrigerant circuit is adopted as the first feature value, wherein the estimating the abnormality includes estimating occurrence of abnormality of the refrigerant circuit by using a detected value of a second feature value by assuming that a state quantity that includes at least one state quantity that is included in the first feature value and at least one state quantity that is not included in the first feature value is adopted as the second feature value.

30. The abnormality estimation method according to claim 29, further including:

a refrigerant amount estimation model that is generated by using the first feature value; and an abnormality estimation model that is generated by using the second feature value, wherein the estimating the refrigerant amount includes estimating the remaining refrigerant amount by applying the detected value of the first feature value to the refrigerant amount estimation model, and the estimating the abnormality includes estimating occurrence of abnormality of the refrigerant circuit by applying the detected value of the second feature value to the abnormality estimation model.

31. The abnormality estimation method according to claim 30, wherein the abnormality estimation mode adopts the second feature value that is used to generate the abnormality estimation model as a normal sample value and calculates an outlier that indicates a degree of deviation from the normal sample value with respect to the acquired detected value of the second feature value, and the estimating the abnormality includes estimating occurrence of abnormality in the refrigerant circuit when an absolute value of the outlier calculated by the abnormality estimation model is equal to or larger than a predetermined threshold, and estimating that the refrigerant circuit is normal when the absolute value of the outlier calculated by the abnormality estimation model is smaller than the predetermined threshold.

32. The abnormality estimation method according to claim 31, wherein the estimating the refrigerant amount includes estimating, only when the estimating the abnormality estimates that the refrigerant circuit is normal, the remaining refrigerant amount of the refrigerant circuit by using the detected value of the first feature value that is acquired at the same time as the detected value of the second feature value that is used when the refrigerant circuit is estimated as normal.

33. The abnormality estimation method according to claim 32, wherein the estimating the abnormality is performed before the estimating the refrigerant amount.

* * * * *